US006910060B2

(12) United States Patent
Langan et al.

(10) Patent No.: US 6,910,060 B2
(45) Date of Patent: Jun. 21, 2005

(54) SPATIO-TEMPORAL FILTER AND METHOD

(75) Inventors: John D. Langan, Santa Barbara, CA (US); Jeffrey S. Scott, Goleta, CA (US); Peter Stobbe, Westlake Village, CA (US)

(73) Assignee: Computational Sensor Corp., Santa Barbara, CA (US)

( * ) Notice: Subject to any disclaimer, the term of this patent is extended or adjusted under 35 U.S.C. 154(b) by 87 days.

(21) Appl. No.: 10/154,200

(22) Filed: May 21, 2002

(65) Prior Publication Data

US 2003/0041084 A1 Feb. 27, 2003

Related U.S. Application Data

(60) Provisional application No. 60/292,219, filed on May 21, 2001.

(51) Int. Cl.[7] ..... G06G 7/02
(52) U.S. Cl. ..... 708/819
(58) Field of Search ..... 708/819

(56) References Cited

U.S. PATENT DOCUMENTS

| | | | | | |
|---|---|---|---|---|---|
| 4,322,697 | A | * | 3/1982 | Carbrey | 333/173 |
| 4,380,756 | A | * | 4/1983 | Worsman | 341/108 |
| 2003/0197636 | A1 | * | 10/2003 | Confalonieri et al. | 341/172 |
| 2003/0216130 | A1 | * | 11/2003 | Dhuna | 455/260 |
| 2003/0231130 | A1 | * | 12/2003 | Confalonieri et al. | 341/172 |

OTHER PUBLICATIONS

See attached list of 14 references–published articles.

C. Mead, Analog VLSI and Neural Systems, Ch. 15, Addison Wesley Publishing Co., Reading, MA, 1989.

J. McElvain, J.D. Langan, R. Behm, M. Costolo, A. J. Heeger, "Spatial frequency filtering using hybrid polymer/VLSI technology" Proc. SPIE vol. 3669, p. 336–344, Smart Structures and Materials 1999: Electroactive Polymer Actuators and Devices, Yoseph Bar–Cohen; Ed.

M.A. Massie, J.T. Wooley, and J.P. Curzan, "Neuromorphic infrared focal plane performs snesor fusion on–plane local contrast enhancement spatial and temporal filtering", Proc. SPIE, Infrared Technology XVIII, vol. 1961, pp. 160–174, 1993.

J. McElvain, J.D. Langan, and A.J. Heeger, "Spatial Frequency Filtering Using Non–Delineated Thin Films", Proceedings of International Conference on Image Processing 3, 380 (1997).

(Continued)

*Primary Examiner*—Tan V. Mai
(74) *Attorney, Agent, or Firm*—Michael G. Petit

(57) ABSTRACT

A system, apparatus and methods are disclosed for the spatial and temporal processing of time dependant array data using analog signal processors. In one embodiment, a programmable array of switched capacitors is used to provide tunable parameters for controlling the desired processing of input data streams. The switched capacitor implementation of a spatial filter provides a massively parallel device that can be programmed to perform isotropic and spatially-oriented anisotropic filtering with low power demands. The system further includes the ability to combine differently filtered output streams with independent multiplicative weights. In another embodiment, the nonlinear spatio-temporal motion energy of a two-dimensional image stream data is computed. The spatial-temporal filter is able to combine multiple analog filters, both spatial and temporal, to perform complex spatial-temporal filtering operations implemented by Gaussian kernel filtering chips. It enables the use of analog spatial-temporal filtered data provided by the chip for computing scene motion energy.

6 Claims, 20 Drawing Sheets

OTHER PUBLICATIONS

D. Scribner, R. Klein, J. Schuler, G. Howard, J. Finch, C. Trautfield, S. Taylor, J. Langan, R. Behm and M. Costolo, "Advanced Focal Planes and Neuromorphic Processing", Meeting of the IRIS (MSS) Specialty Group on Ifrared Detectors, Aug. 1999.

J.P. Antoine, R. Murenzi, "Two–dimensional wavelets and the scale–angle representation", Signal Processing, 52, 259–281, 1996.

E. H. Adelson and J. R. Bergen, "Spatiotemporal energy models for the perception of motion", J. Opt Soc. Am. A, vol. 2, No. 2 Feb. 1985, pp 284–299.

Simoncelli E.P., Adelson E.H. and Heeger D.J. (1991), "Probability distributions of optical flow". IEEE Proc. Of CVPR, Maui pp. 310–315.

J. L. Barron, D. J. Fleet, and S. S. Beauchemin. "Performance of optical flow techniques", Intl. J. Comp. Vis., 12(1):43–77, 1994.

S.J. Nowlan and T.J. Sejnowski, "Filter selection model for motion segmentation and velocity integration", J. Opt. Soc. Am. A, vol. 11,No. 12, Dec. 1994.

D.A. Scribner, K.A. Sarkady, M.R. Kruer, and J.T. Caulfield, "Adaptive nonuniformity correction for staring IR focal plane arrays using neural networks", SPIE, vol.1541, 1991.

James Arnold, Scott Shaw, and Henry Pasternack, "Efficient Target Tracking Using Dynamic Programming", IEEE Transactions on Aerospace and Electronic Systems vol. 29, No. 1, Jan. 1993,pp 44–56.

J.D. Langan, J. Scott, L. Becker, T. Wilson, K. Smith, "Performance Evaluation of Motion Energy Sensor Technology for Missile Defense–A Preliminary Report", Meeting of the IRIS (MSS), Nov. 2001.

M. Moore, J.S. Scott, J.D. Langan, D. Scribner, G. Benedict–Hall, "Application of Analog Spatio–Temporal Image Filtering to Threat Cloud Discrimination", MSS–Passive Sensors, Apr. 2002.

* cited by examiner

SPATIO-TEMPORAL FILTER AND METHOD

This application claims the benefit of Provisional Application No. 60/292,219, filed May 21, 2001.

STATEMENT REGARDING FEDERALLY SPONSERED RESEARCH OR DEVELOPMENT

This invention was made, in part, with Government support under contract DASG60-99-C-0017 awarded by U.S. Army Space and Missile Defense Command. The Government has certain rights in the invention.

BACKGROUND OF THE INVENTION

1. Field of the Invention

The present invention relates to signal and image processing systems; more particularly, the present invention relates to the real-time spatial and temporal processing of time dependent array data. The present invention also relates to compact, low powered analog VLSI devices that are used in performing spatial and temporal data processing of signals and images.

2. Prior Art

Spatial and temporal filtering is essential to a variety of signal and image processing applications. Applications such as security and surveillance rely on the real-time spatial and temporal processing of live image data. In military applications, spatial and temporal processing is used for the detection and tracking of targets. Image processing systems are important and, in some cases, critical, in applications where limited space, mass, and power requirements are present together with the need for very large computational rates. This is particularly important in military systems on small remote platforms where the computation of spatial frequency filtering involves large convolution operations. Such requirements also exist in commercial systems, particularly in image processing applications, where computational bottlenecks exist such as the interface between focal plane arrays and subsequent image processing. There is an ongoing need for high performance discrimination systems that center on non-stationary spatial and temporal effects as occur for example in missile defense interceptor seeker applications and in commercial bio-mimetic recognition systems.

Spatial frequency filtering in the analog domain by the use of discrete FET circuits forming a resistive array grid is known in the art [1]. This approach is limited to relatively large unit cell areas and although the FET operation in subthreshold conditions resulted in reduced power consumption as compared to conventional designs, the net power dissipation for a large staring array is prohibitive. The signal injection into the resistive grid array is provided by means of controllable conductive inputs. Furthermore, this approach suffers from slow response time that is incompatible with the readout requirements of contemporary high frame rate staring array readout focal plane technology.

An alternative version of the resistive grid has been implemented using a high resistance polymer sheet resistivity approach to form the array lateral interconnections as disclosed in U.S. Pat. No. 6,208,006, issued Mar. 27, 2001, entitled "Thin film spatial filters", by McElvain et al. This approach allows the extension of resistive array processing to large focal plane formats with low power requirements. Moreover, the method implements a means of processing that both "read-out" a filtered array, and "read-in" a new array image from a multiplexer arrangement thereby allowing an architectural approach to low, high and band pass filtering. Implementation of this approach, although not patented but reported in the literature [2], differs in the method of inserting signals into the resistive grid array when compared to the direct conductance approach. This has been accomplished by the use of capacitor storage to inject charge discretely into the resistive grid array resulting in a Gaussian blurring. However the complexities and control of post foundry processing of the polymer resistive layer makes that process unstable and disadvantageous for production application. The polymer approach has the potential for anisotropic filtering to localize two-dimensional spatial frequency filtering. However, in practice this approach requires a separate anisotropic application for each anisotropic filtering direction and degree of anisotropy. This results in a large number of chips to accomplish the same filtering operation as well as the insertion loss associated with each additional chip.

An alternative approach to resistive grid formation utilizes a switched capacitor resistive grid whereby the filter blurring is created by clocking charge through the lattice of switched capacitor circuits [3]. This approach utilizes the injection of signals to the resistive grid by controllable conductances and allows only isotropic filtering in the switched capacitor resistive grid.

An approach to temporal filtering has been implemented by the use of switched capacitor integration of charge for both high and low pass temporal filtering as disclosed in U.S. Pat. No. 6,040,568, issued Mar. 21, 2000, entitled "Multipurpose readout integrated circuit with in cell adaptive non-uniformity correction and enhanced dynamic range", by Caulfield et al. In this invention, the device is confined to the application of filtering an image formed by transduction within the device for purposes of sub-frame averaging and scene non-uniformity correction.

The majority of signal and image processing systems in operation today rely on digital processors. Although these systems are extremely versatile, they are not able to process large images at high rates because the digital processors employed in these systems have limited computational power and require a large amount of electrical power to operate (a typical desktop computer consumes about 75 watts). When limited to using only low powered devices, the existing data processing systems cannot handle high data rates. In other words, existing digital processing systems lack the ability to process large amounts of data in real time with limited power.

Analog signal and image processing systems such as disclosed in U.S. Pat. No. 6,208,006, issued Mar. 27, 2001, entitled "Thin film spatial filters", by McElvain et al. [1][4][5], have recently been implemented and are indeed capable of processing large amounts of data in real-time with low power requirements. Currently available analog signal and image processing systems have little flexibility or programmability, and therefore device operation is highly restrictive with a limited range of applications. It can be appreciated that it would be highly desirable to have a flexible and low-powered apparatus for spatio-temporal filtering. The prior art discussed above does not adequately address these needs.

SUMMARY

It is a first object of the present invention to provide a programmable apparatus for spatial frequency filtering using a switched capacitor array to interconnect a planar array of grounded capacitors charged in proportion to signal data values.

It is another object of this invention to provide a device and method for low-pass, high-pass, band-pass and other spatial frequency filtering operations.

It is yet another object and advantage of this invention to provide a means for achieving a variety of tunable filtering operations, which includes anisotropic spatial frequency filtering.

It is still another object and advantage of this invention to provide methods for the spatial and/or temporal processing of time dependant array data using a plurality of analog signal processors.

It is another object and advantage of this invention to provide methods for the linear spatio-temporal filtering of time dependant two-dimensional images.

It is another object and advantage of this invention to provide methods for the computation of non-linear spatio-temporal motion energy from two-dimensional image sequences.

The above objectives of the present invention are realized by providing a method and apparatus for spatial frequency filtering employing switched capacitor resistive interconnects between processing nodes of analog VLSI circuits that allow flexible control of blurring for spatial frequency filtering. The combination of a switched capacitor resistive layer and a charge blurring structure involving the controlled diffusion from a separate capacitor array, charged in proportion to the incoming image intensity, performs the blurring operation in a flexible and anisotropically constrainable manner enabling a variety of image convolution operations.

With reference to FIGS. 1A and 1B, a resistive network interconnecting grid node 0, on a rectilinear grid with grid spacing a, to neighboring princicple axis nodes and grid nodes $\sqrt{5}a$ distant is shown in FIG. 1A. A switched capacitor implementation, FIG. 1B, is shown only for the connections between the three vertical nodes as indicated by the vertical arrow in FIG. 1A. A capacitor $C_S$ and an adjacent switch on each side (labeled 1 and 2), define a resistive path between two node capacitors $C_B$ with an effective resistance controlled by the rate at which the switches operate. This method enables the determination of subtle discrimination of non-stationary spatial frequency components and other filtering operations. The present approach further eliminates complicated polymer device processing subsequent to the Silicon VLSI foundry device fabrication.

In accordance with the present invention, a temporal filtering chip that operates on the same analog multiplexed processing scheme as the spatial processing approach is used in conjunction with the spatial switched capacitor device in a nonlinear spatio-temporal (S-T) motion energy aparatus that enables a wide variety of early vision processing operations to be performed in a compact, power efficient form with large computational power. The temporal filtering chip differs from the spatial filtering chip by applying a band pass kernel to past frames in a weighted average to produce a present frame output. The S-T filtering and motion energy computation available using the S-T filtering apparatus is illustrated in FIG. 1C.

Methods and apparatuses for spatial and temporal processing of time dependent array data using analog signal processors are disclosed. In one embodiment, a programmable apparatus for spatial frequency filtering using a switched capacitor array to interconnect a planar array of grounded capacitors charged in proportion to input data values is shown to provide a programmable spatial frequency filtering device. In another embodiment, it is shown how the above apparatus can be simply modified to perform low-pass, high-pass, band-pass and other spatial frequency filtering operations. In yet another embodiment, it is also shown how the capacitors of this device can be interconnected and properly driven to perform a variety of tunable filtering operations, which includes anisotropic spatial frequency filtering. In another embodiment, an apparatus for the spatial and/or temporal processing of time dependant array data using a plurality of analog signal processors is presented. In yet another embodiment, a method is shown for the linear spatio-temporal filtering of time dependant two-dimensional images. In a further embodiment, a method for the computation of non-linear spatio-temporal motion energy from two-dimensional images is disclosed. Methods are presented for several motion energy applications including target detection, sub-pixel target identification based on rotational dynamics and closely spaced objects.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

DEFINITIONS

Figure 1A:
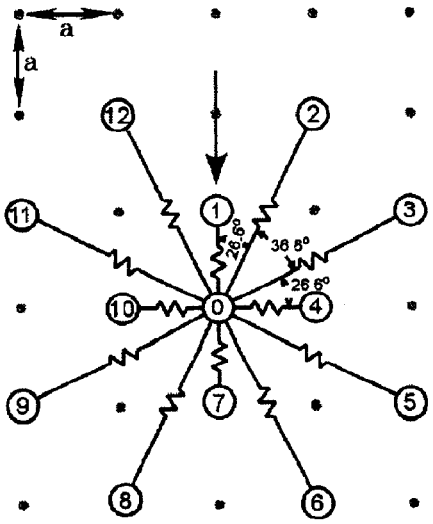
FIG. 1A is a schematic diagram illustrating a resistive network interconnecting other nodes of a square grid lattice.
Figure 1B:
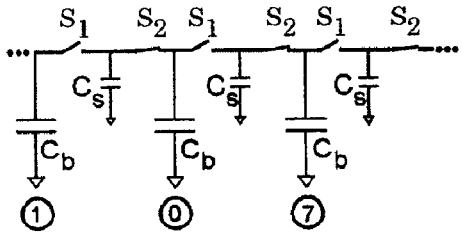
FIG. 1B shows a switched capacitor implementation connecting three vertical nodes.

| Term | Definition |
|---|---|
| 1-D | One dimensional |
| 2-D | Two spatial dimensions |
| 3-D | Two spatial dimensions and one temporal dimension |
| Anisotropic | Varying with spatial direction. |
| Band pass filter | A filter that ideally passes all frequencies between two non-zero finite limits and attenuates all frequencies not within those limits. |
| Basis function control | The ability to adjust and modify the functional parameters of a device in order to approximately cover a desired operating range. |
| Cascade | A method of connecting multiple stages, where the output of one stage serves as the input for a subsequent stage. |
| Continuous wavelet transform | An effective way to analyze nonstationary signals and to localize and characterize patterns. |
| Convolution | The operation of repeatedly projecting one data set on that of another with all possible spatial translations. |
| Dynamic programming | An algorithm in which the definition of a function is extended as the computation proceeds. |
| FET | Field Effect Transistor |
| FFT | Fast Fourier Transform |
| Filter | A device that transmits only part of the incident energy and changes the spectral distribution of energy. |
| Fixed pattern noise | Image noise commonly found in infrared and CMOS image sensors often caused by manufacturing variations. |
| Fourier transform | Mathematical technique for converting a time domain signal f(t) to a frequency domain signal f(w), and vice versa. |
| FPGA | Field Programmable Gate Array |
| FPS or fps | Frames per second |
| Gaussian filter | A filter having a response curve (magnitude versus frequency) that approximates an ideal Gaussian curve. |
| Gradient | The rate of change dependence of a given quantity upon a single parameter. |
| High-pass filter | A filter that passes frequencies above a given frequency and attenuates all others. |
| Inter-pixel | Connections between neighboring pixels in a two-dimensional x y array. |
| Isotropic | Behaving identically in different spatial directions. |
| Kernel | The impulse response of a filter |
| Low-pass filter | A filter that passes frequencies below a specified frequency and attenuates higher all others. |
| Multiplicative weight | Gain or ratio of output to input. |
| Multiresolution | Simultaneously spanning multiple signal scales and/or multiple frequency bands. |
| Nonuniformity correction (NUC) | Corrections to fixed pattern noise in images. |
| Optical flow | The measure of apparent motion in image sequences. |
| Orientation | A unique direction in space. |

-continued

DEFINITIONS

| Term | Definition |
|---|---|
| Pipelined dataflow | High throughput system design where new image data is read in simultaneously with the output of processed image data. |
| Progressive scan | Sequential delivery of complete image frames. |
| Parallel | A method of connecting multiple stages, where all the stages have the same input. |
| SCSFC | Switched Capacitor Spatial Filter Chip |
| Shifting operations | A fixed displacement of signal or pixel coordinates. |
| Signal | Image transmitted energy that can be used to carry information. |
| Signal data values | A plurality of image intensity values or signal values. |
| Sinc function | Sin(x)/x |
| Spatial filter | Spatial frequency filter. |
| Spatial frequency filter | A device that transmits and redistributes part of the spatially incident energy and changes the spatial spectral distribution of energy. |
| Spatial frequency filter extent | A measure of the signal redistribution distance. |
| Spatial frequency filter orientation | A preferred direction for spatial redistribution of the input signal. |
| Spatial frequency filter aspect ratio | The ratio of the spatial redistribution of the input signal in two perpendicular directions. |
| Spatial shifting | The introduction of a discrete spatial offset between the pixel contents of an image frame and the original frame. |
| Spatio-temporal (S-T) | Pertaining to both space and time. |
| Spatio-temporal frequency filter | A device that transmits and redistributes part of the spatially and temporally incident energy and changes the spatial and temporal spectral distribution of energy. |
| Spatio-temporal motion energy | A measure of motion in spatial direction in time varying images. |
| Sub-pixel resolution | Isolating the location of features within an image to a resolution that is smaller than the distance between pixels. |
| Switched Capacitor Resistor | A circuit constructed from a capacitor and dynamical switches that behaves similar to a resistor. |
| TAIP | Thin film Analog Image Processor or a thin film spatial frequency filter. |
| Topology | The configuration of wire connections interconnecting elements in a network. |
| VLSI | Very Large Scale Integration |

DESCRIPTION OF THE PREFERRED EMBODIMENTS

A method and apparatus for spatial and temporal processing of time dependent array data are described below. In the following description, numerous details are set forth. It will be apparent, however, to one skilled in the art, that the present invention may be practiced without these specific details. In other instances, well-known structures and devices are shown in block diagram form, rather than in detail, in order to avoid obscuring the present invention.

Description—Switched Capacitor Spatial Filter Chip

The Switched Capacitor Spatial Filter Chip (SCSFC) is an image processing building block performing isotropic or orientated spatial filtering of monochromatic video. The chip preferably has three low-pass spatial filter processing modes: isotropic two-dimensional, oriented (anisotropic) two-dimensional or one-dimensional (isolated row-by-row). The oriented filtering can be in any one of six set angles, although other angles are possible in alternative embodiments. Multiple chips can be used to create more complex filters through serial and parallel architectures.

The chip is a frame-oriented device requiring a serial video input of time division multiplexed pixels, progressive scan, with a nominal frame rate of 60 FPS. The general operation of the chip is pipelined such that the previous processed frame is being output while the next raw frame is being loaded.

Figure 2:
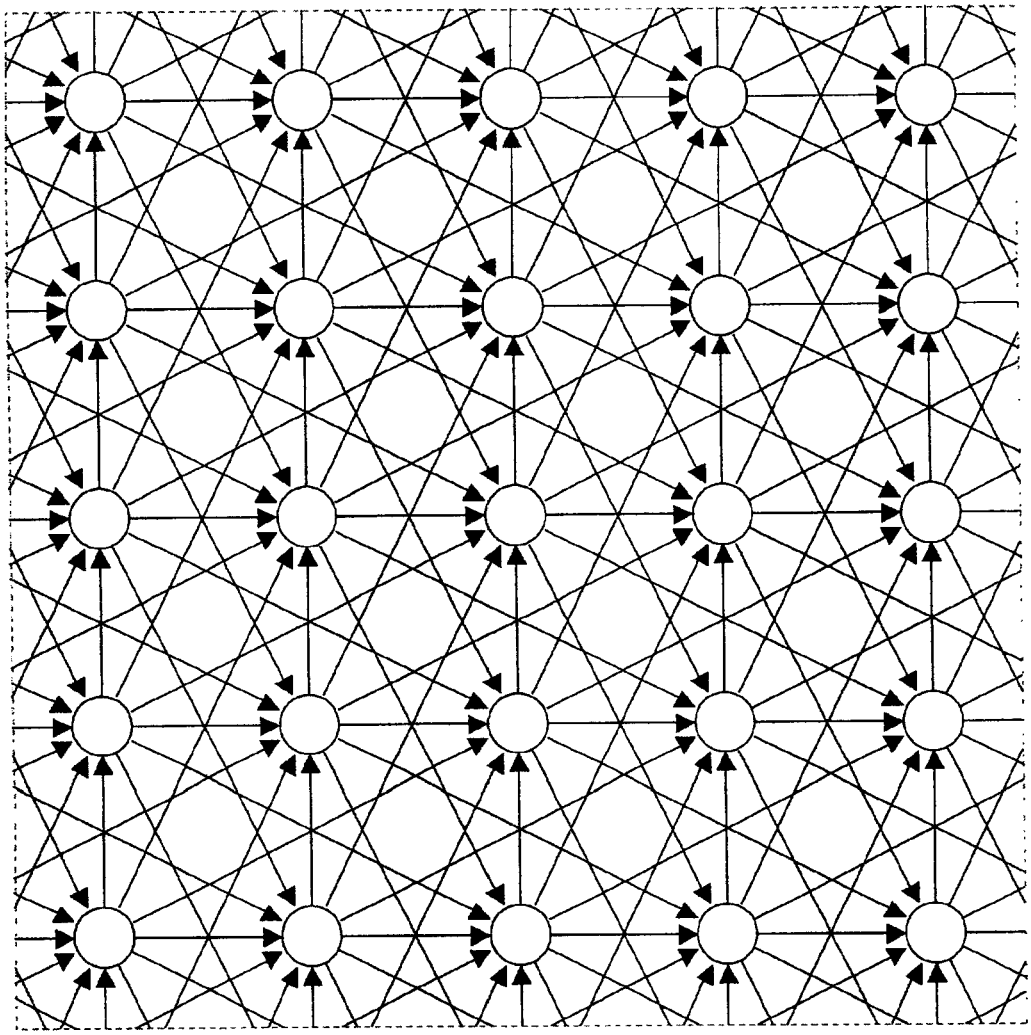
FIG. 2 shows an interior part of a grid of unit cells, and the topology of the wires connecting them.
Figure 3:
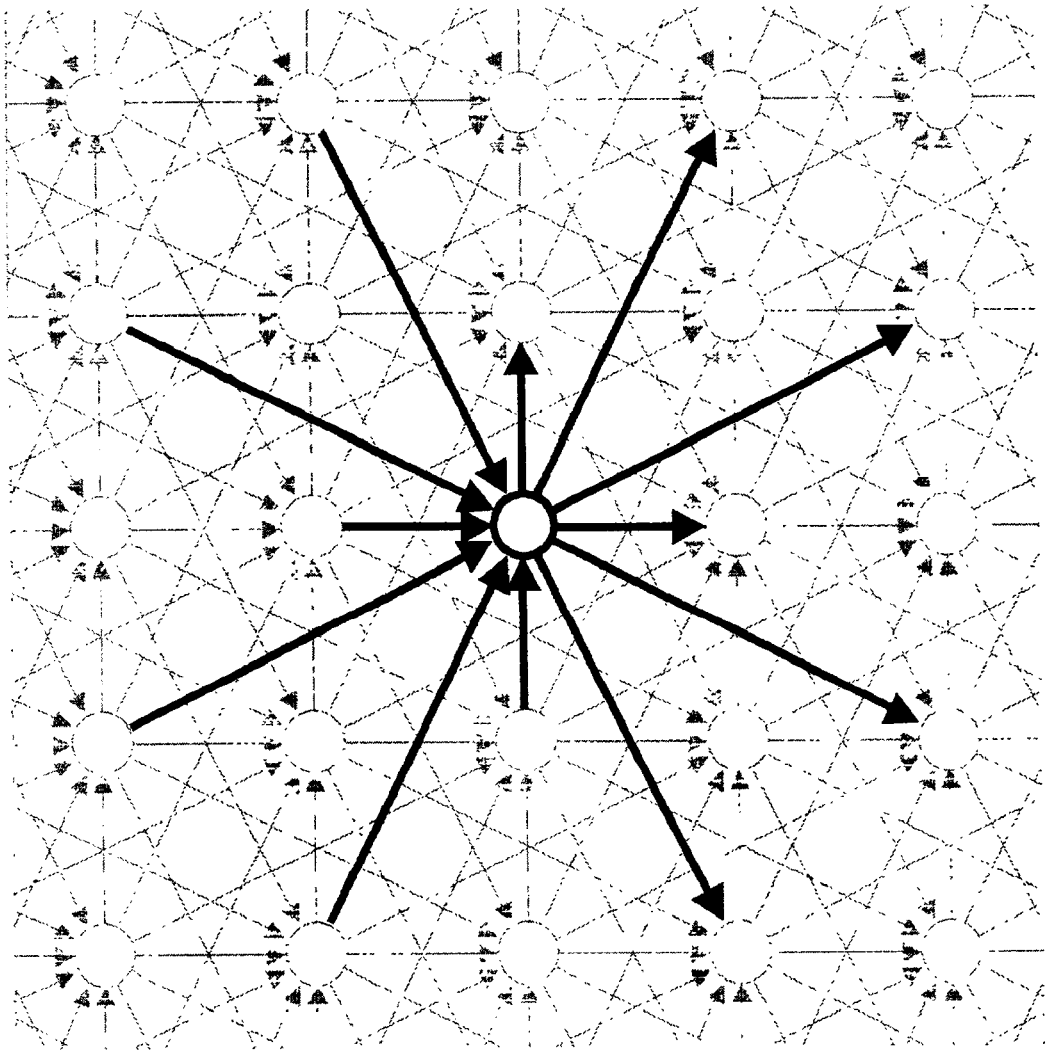
FIG. 3 is the same as FIG. 2, but with one of the cells and all connections to and from the cell indicated in bold arrows.
Figure 4:
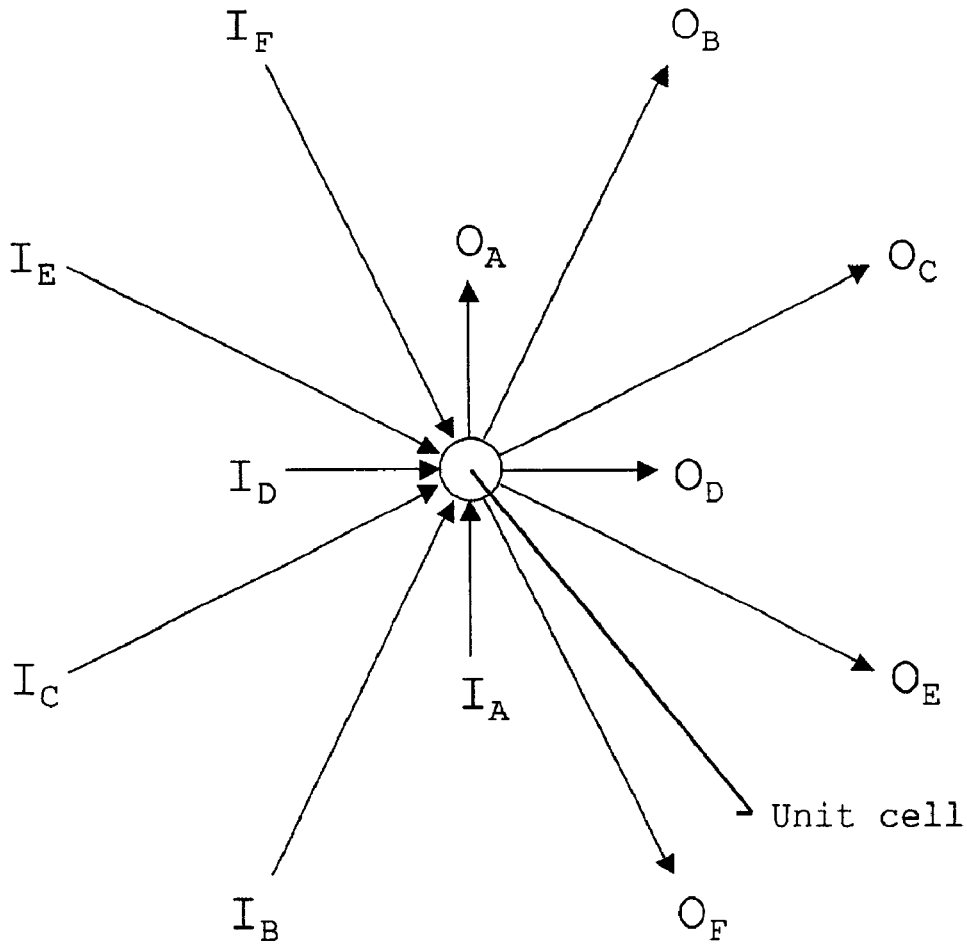
FIG. 4 is a cell with all connections to and from it labeled.
Figure 5:
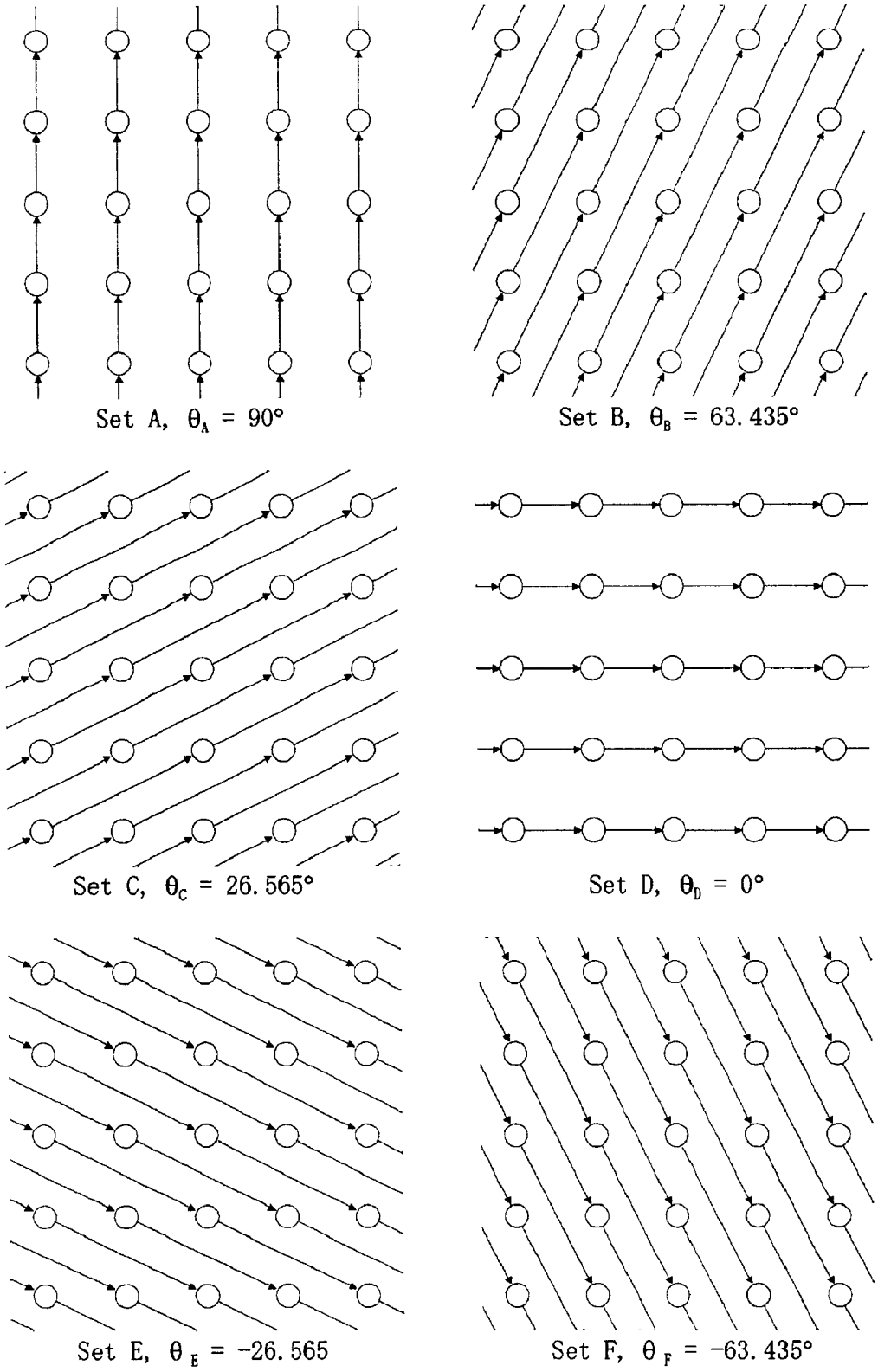
FIG. 5 shows the different sets of connections for an interior part of a grid of unit cells.

The main part of the chip consists of a grid of unit cells, connected by wires. The internal contents of the unit cells are independent of the overall topology. FIGS. 2, 3, and 4 form a sequence illustrating the topology. The topology of an interior part of a grid in accordance with the present invention is shown in FIG. 2, wherein circles represent unit cells and lines with arrowheads represent wires. The arrowheads point in the direction from the output to the input. Each cell has six output wires and six input wires connecting to other cells. To highlight this, FIG. 3 is the same as FIG. 2, except a particular unit cell and attached wires are shown in bold type, while the rest of the diagram is grayed. The output for one cell serves as the input for another cell and vice-versa. Hence we can define six different sets of wires by their output displacement in x-y coordinates. For example, Wire Set A is the set of wires connecting cells displaced by (0, +1). Similarly, Wire Sets B, C, D, E, and F are the sets of wires connecting cells displaced by (+1, +2), (+2, +1), (+1, 0), (+2, −1), and (+1, −2) respectively. The sets are shown in FIG. 5. Wire sets A and D comprise the "nearest neighbor" connections. The other wire sets comprise the "non-nearest neighbor" connections.

FIG. 4 shows an example unit cell and attached wires, with the parts labeled. For the example unit cell, $I_A$ is the input belonging to wire set A, and $I_B$ is the input belonging to wire set B, and so on. Likewise, $O_A$ is the output belonging to wire set A, and $O_B$ is the output belonging to wire set B, and so on.

Figure 6:
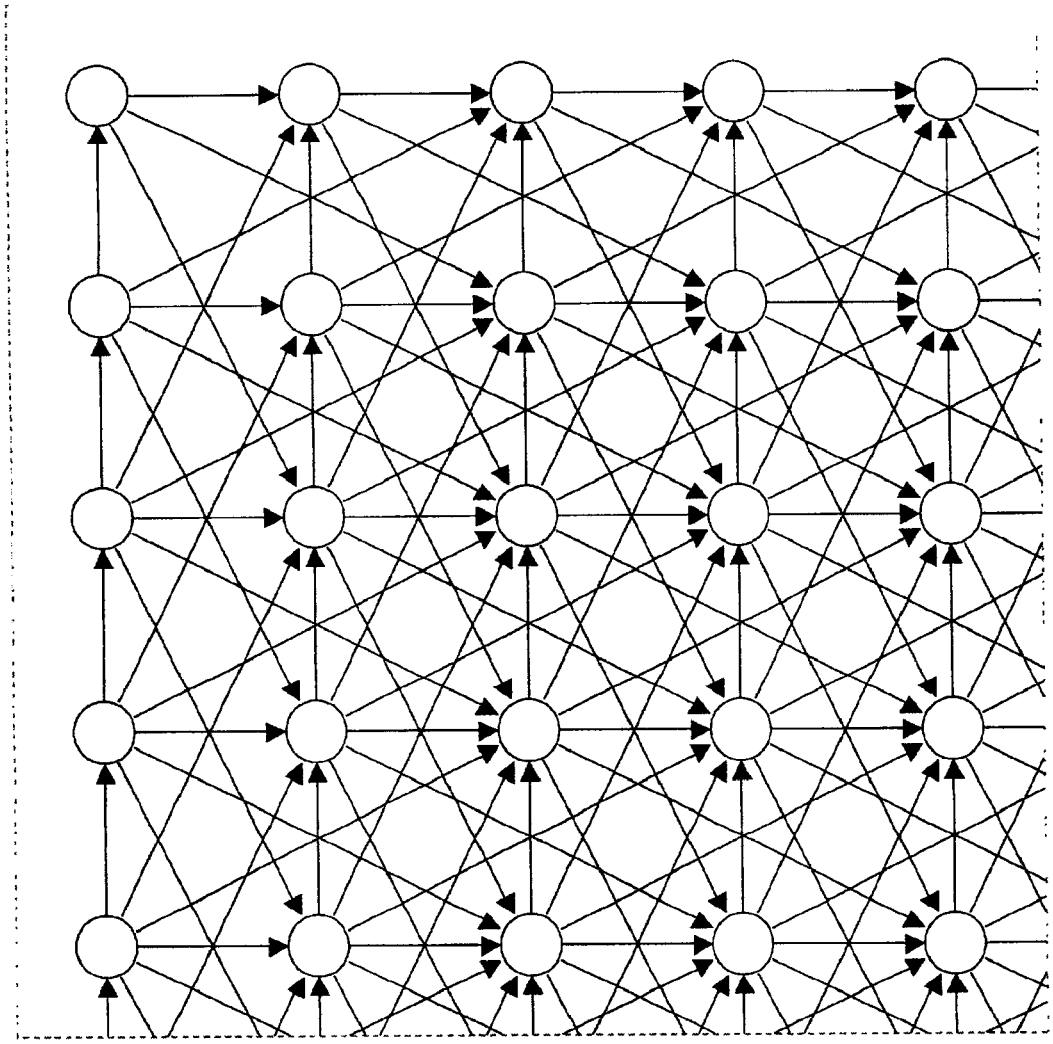
FIG. 6 shows a corner part of a grid of unit cells, and the topology of the wires connecting them.

Along the edges of the grid, cells are not connected to a full complement of other cells. If there is no cell to connect to, for a particular cell and a particular displacement, then the wire is simply omitted, as shown in FIG. 6. This causes the data along edges to be operated upon differently than that of the interior, but this is expected since the edges are by definition exceptional areas.

Figure 7:
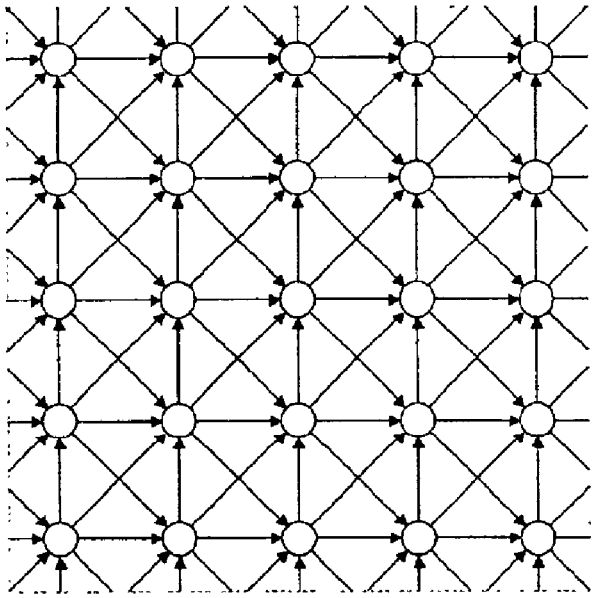
FIG. 7 shows an interior part of a grid of unit cells, with an alternative topology of the wires connecting them.
Figure 8:
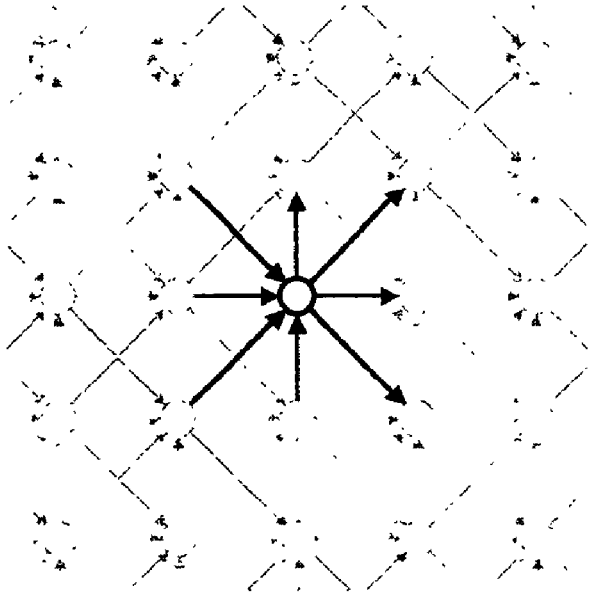
FIG. 8 is the same as FIG. 7, but with one of the cells and all connections to and from it in bold.
Figure 9:
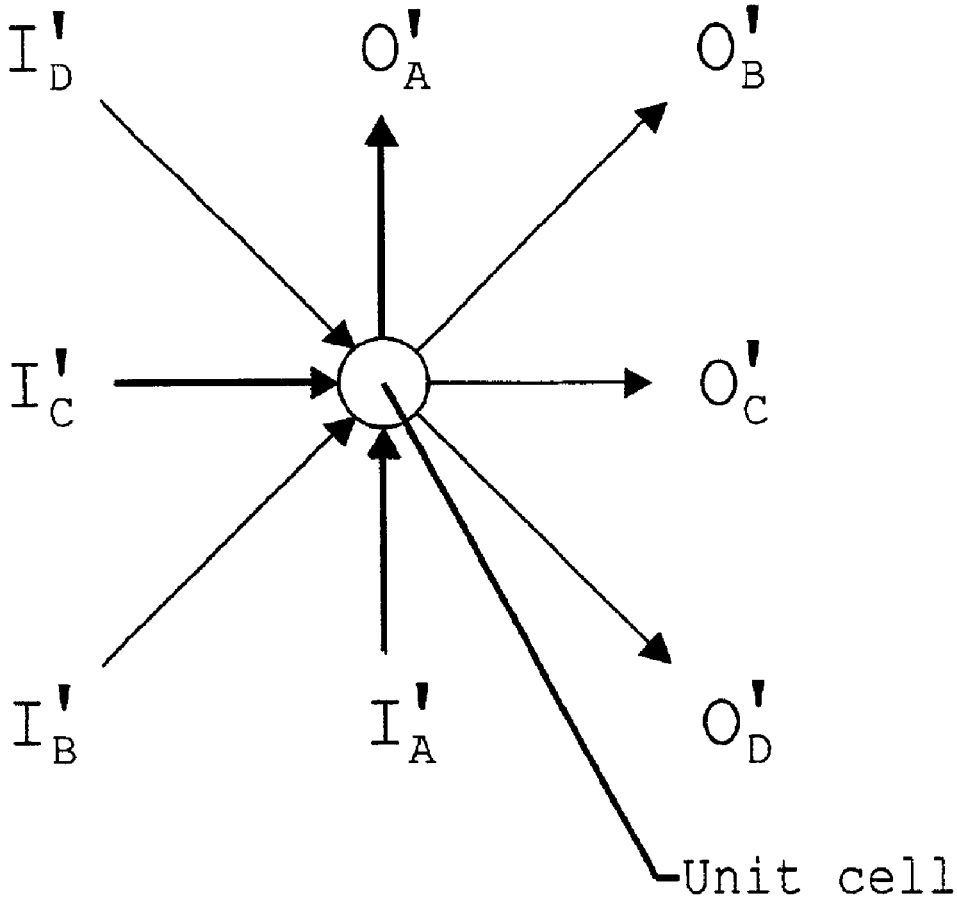
FIG. 9 is a cell with all its connections from an alternative topology.

The wire topology also determines the possible filtering orientations. Instead of the wire sets A–F, one could connect cells with other topologies. One example would be to connect nearest neighbors as well as cells displaced from each other by (+1, +1) and (+1, −1). This is shown in FIGS. 7–9, which are analogous to FIGS. 2–4. This topology allows for oriented filtering every forty-five degrees, which is fewer directions than the preferred topology. It is conceivable as well that the cells on an edge could be connected with wire wrapped around to the opposite edge, forming a toroidal topology. This presents no advantage unless the data to be analyzed is inherently periodic. That is, it introduces errors to treat points that are on opposite sides of the grid as being adjacent. Only truly adjacent points should be treated as adjacent.

Figure 10:
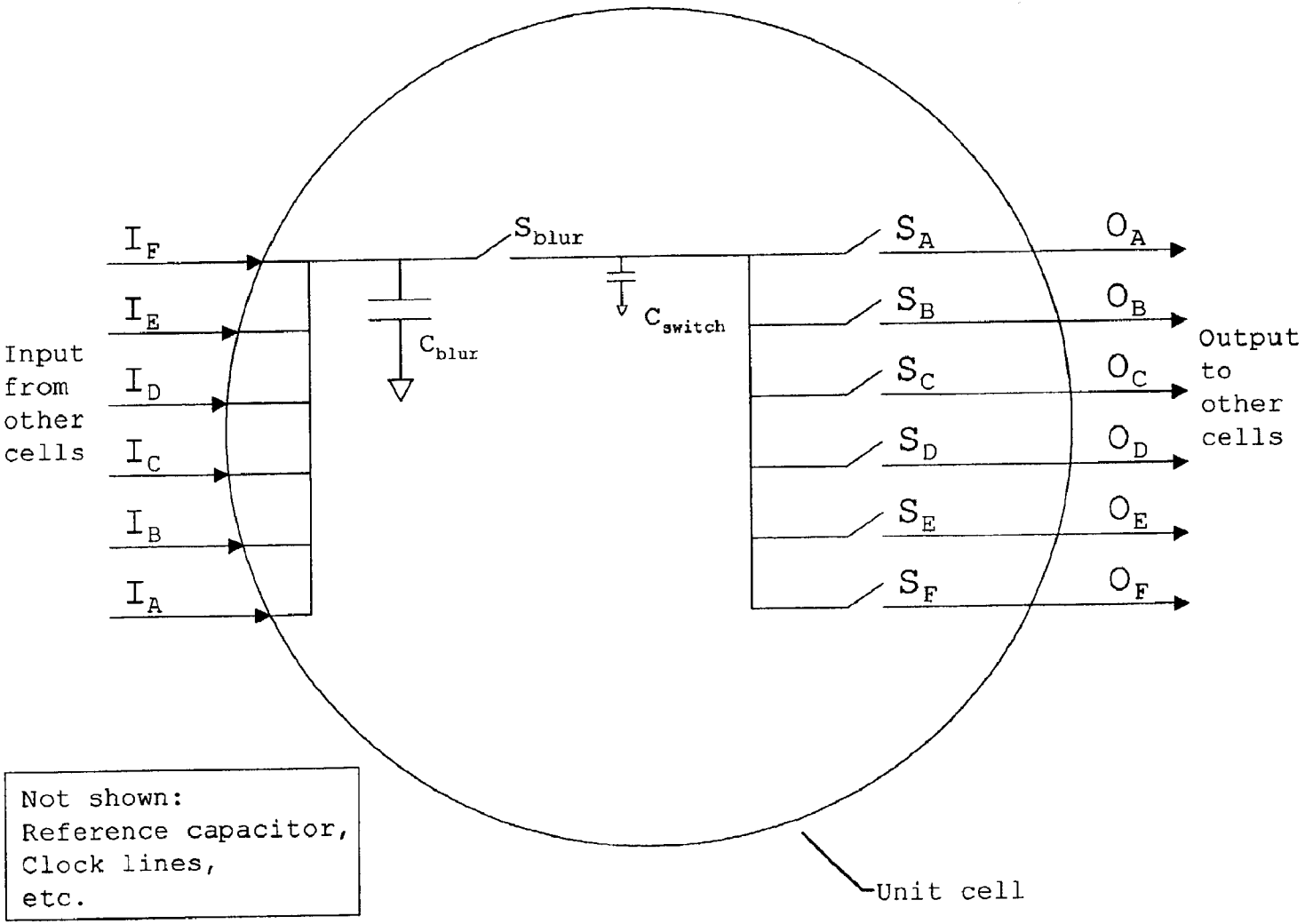
FIG. 10 is the preferred unit cell layout.

The preferred embodiment of a unit cell is shown in FIG. 10. The unit cell contains a blur capacitor $C_{blur}$, a switch capacitor $C_{switch}$, and several switches $S_A$–$S_F$ that control the blurring process. Clock lines (not shown) are connected to every unit cell control the switches $S_A$–$S_F$. The blur capacitor stores charge proportional to the data for that pixel. The switch capacitor acts as an intermediary between the blur capacitors from different unit cells.

Figure 11:
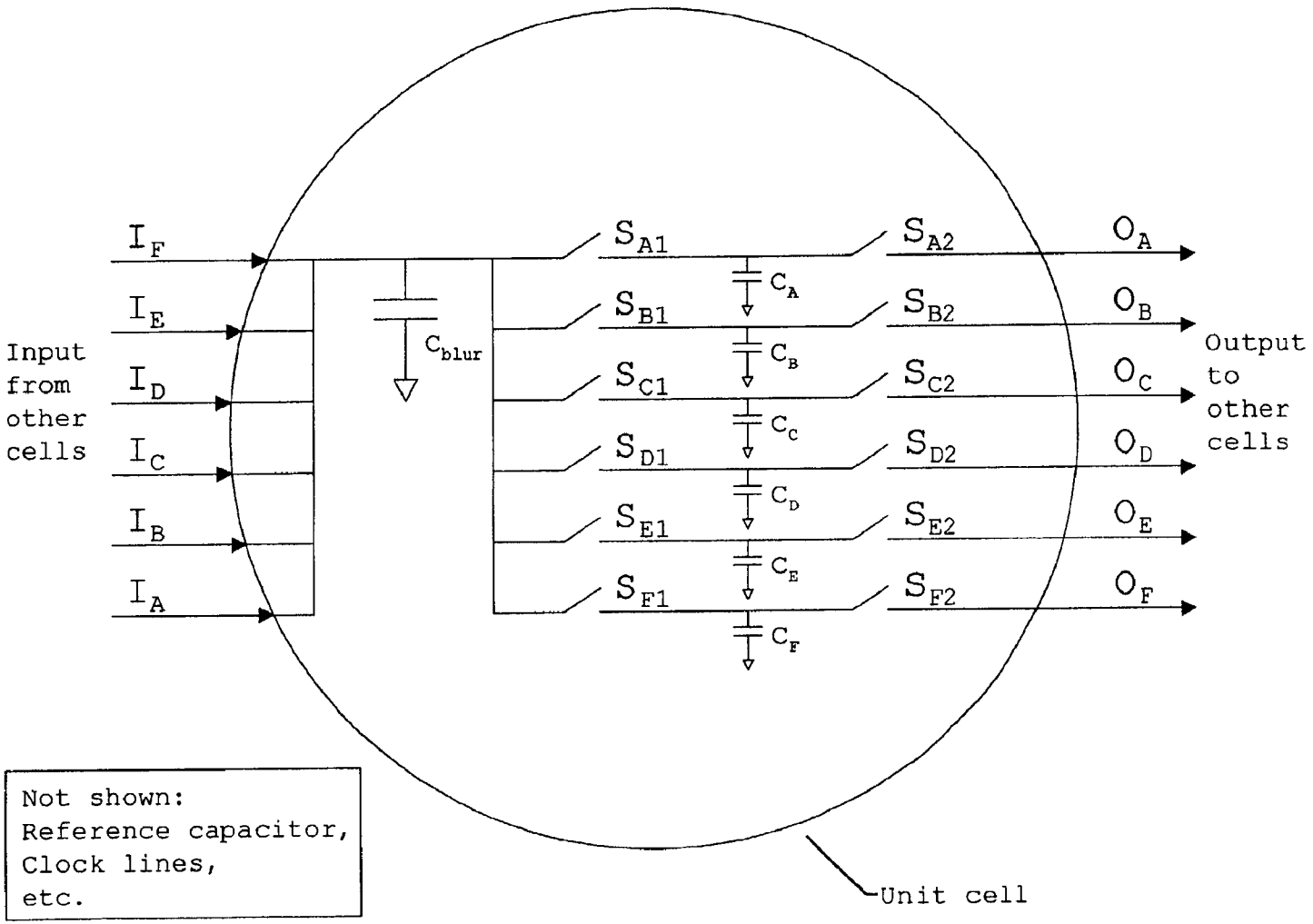
FIG. 11 is an alternative unit cell layout.

An alternative embodiment of the unit cell is shown in FIG. 11. In this case, there is a switch capacitor $C_A$–$C_F$ for each wire cell, as well as two switches $S_{A1}$–$S_{A2}$ for $C_A$ etc. The advantage of this configuration is that it makes it possible to operate different switch sets simultaneously. The results should be the same whether the different switch sets operate simultaneously or sequentially, so the simpler embodiment in FIG. 10 is preferred.

Operation—Spatial Switched Capacitor Chip

As shown in FIG. 10, the Wire Sets, indicated at I and O, have independently controlled switches within the unit cells. Hence we refer to Switch Sets A–F, which directly correspond to the Wire Sets A–F. Each time a Switch Set in the network cycles, charge diffuses slightly along the direction of the connections. The operation is a mathematical convolution (barring edge effects). Convolutions commute with each other; that is, they can be performed in any order to get the same result. Hence, if edge effects are ignored, it makes no difference what order the sets of switches are operated. The operation can be analyzed in one dimension, and extending it to multiple directions is straightforward.

One-dimensional Analysis

Figure 12:
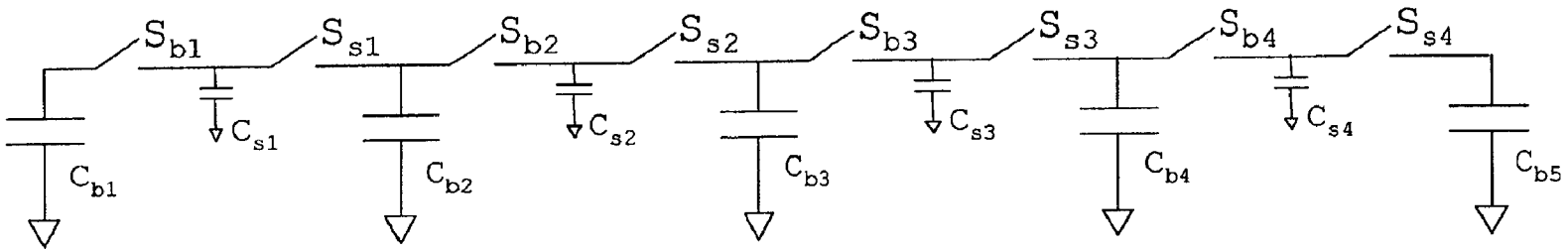
FIG. 12 is a switched capacitor array that interconnects a planar array of grounded capacitors.

Consider the capacitors, wires and switches along a single line of a single direction only. The circuit reduces to one such as shown in FIG. 12. Note there are two types of switches: "b" and "s". All switches of the same type are controlled by the same clock line (not shown), and run synchronously. Initially, the data is loaded in with the "b" switches closed and the "s" switches open. By "loaded in", it is meant that each blur capacitor is charged up proportional to the data value for the pixel it represents. Charging the blur capacitors with one set of switches closed removes residual charge on a switch capacitor from the preceding frame. Then a controllable number of switching cycles are performed. A switching cycle consists of opening the "b" switches and closing the "s" switches, and then opening the "s" switches and closing the "b" switches. A half-cycle might be asymmetric, but the net effect of a complete cycle is symmetric. We can describe the net operation of a single cycle with the following simple update rule:

$$Q(n,t+1)=Q(n,t)-\alpha(2Q(n,t)-Q(n-1,t)-Q(n+1,t)) \quad (1)$$

$$\alpha=\frac{C_sC_b}{(C_s+C_b)^2} \quad (2)$$

This analysis ignores edge effects; it is only true for interior points. However edge effects are minor and easy to correct for. Q(n,t) is the charge on blur capacitor n after cycle t. Alpha is a small fixed number, roughly equal to the capacitance ratio of the switch capacitor to the blur capacitor. In the preferred embodiment, this capacitance ratio is about 1:50. Note that the total amount of charge remains constant (zero frequency element of signal unchanged.) The discrete Fourier transform of the above equation is:

$$\tilde{Q}(k,t+1)=(1-\alpha(2-2\cos k)\tilde{Q}(k,t) \quad (3)$$

Hence the transfer function for M cycles is given by:

$$H(k)^M=(1-\alpha(2-2\cos k))^M \quad (4)$$

This is a Gaussian low pass filter parameterized by the number of cycles. This is apparent by making several of approximations.

$$H(k)^M\approx\exp(-\alpha M(2-2\cos k)) \text{ if } \alpha<<1\approx\exp(-\alpha Mk^2) \text{ if } \alpha<<1 \text{ and } k<<1 \quad (5)$$

As the number of switch cycles increases, the spatial extent of the convolution kernel increases. This corresponds to a lower cutoff frequency in the frequency domain.

2-D Blurring

Figure 13A:
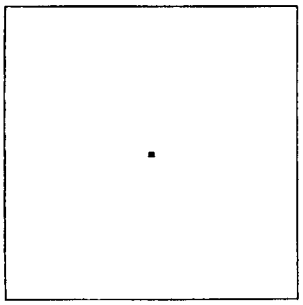
FIG. 13A is an input image (a single black pixel in a white field).
Figure 13B:
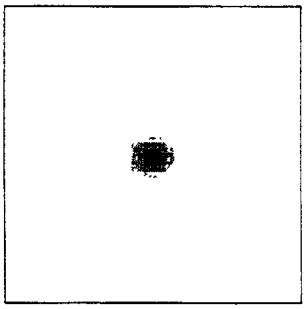
FIGS. 13B–F are different normalized outputs demonstrating isotropic blurring.
Figure 13C:
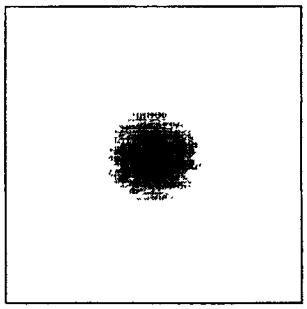
Figure 13D:
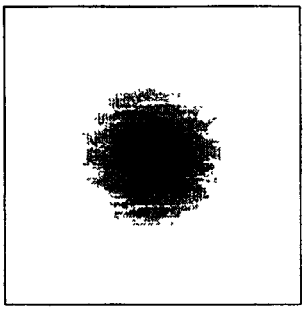
Figure 13E:
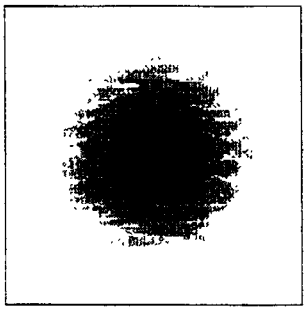
Figure 13F:
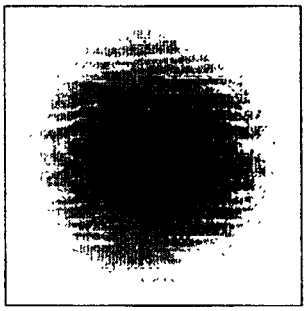

Two-dimensional isotropic low pass filtering is implemented by programming the device to blur for a number of cycles with switch set A and an equal number of cycles with switch set D. Visually the effect of this is to blur the image. This is demonstrated in FIG. 13. FIG. 13A shows an input image: a white field with a single black pixel. FIGS. 13B through 13F show successive isotropic blurs of the input, respectively at 100, 400, 900, 1600, and 2500 switch cycles in each direction. FIG. 13J shows 1-D cuts of these output images along the center row. Note however that these output images are normalized; gain is applied appropriately to utilize the full dynamic range. Clearly, by controlling the number of switch cycles, one can control the spatial extent of the blurring.

Figure 13G:
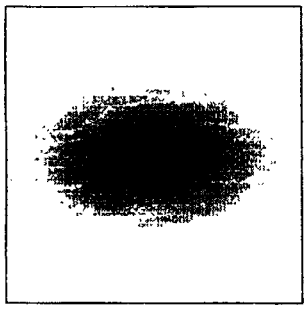
FIGS. 13G–I are different normalized outputs demonstrating anisotropic blurring.
Figure 13H:
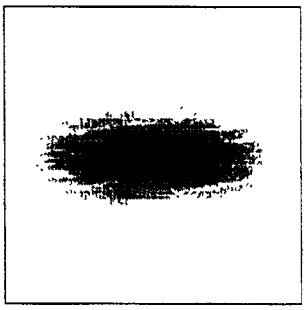

If the number of cycles in the two directions is different, the blurring will be anisotropic, as shown in FIGS. 13G and H. In these figures, the image has been blurred for 2500 switch cycles in the x-direction and fewer cycles in the y-direction (900 in 13G and 400 in 13H). Equivalently stated, FIG. 13H was blurred isotropically for 400 switch cycles, along with an extra 2100 cycles along Switch Set D.

Figure 13I:
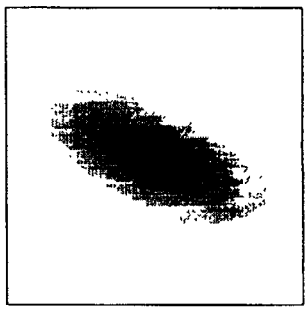
Figure 13J:
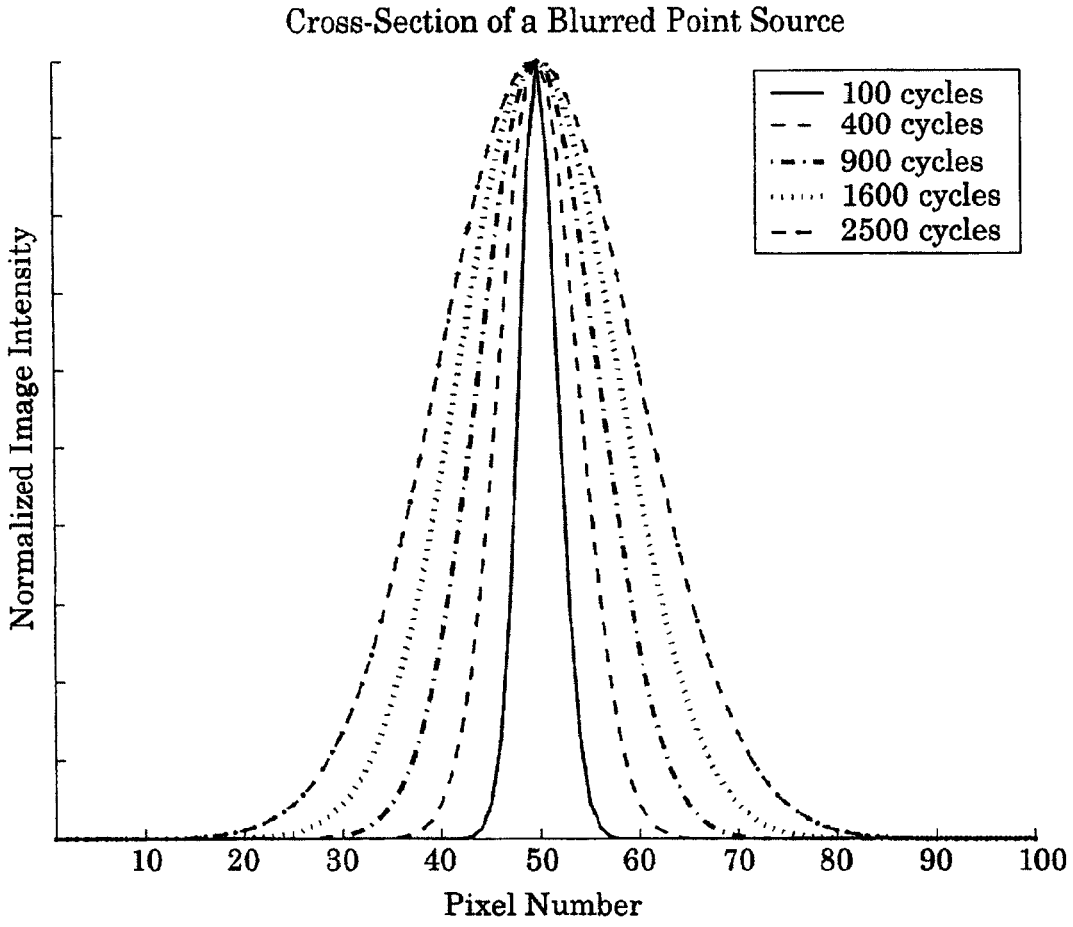
FIG. 13J is a plot of 1-D cuts of the isotropic blurring output images shown in FIGS. 13B–F.

The Switched Capacitor Spatial Filter Chip can also be used to blur along the directions of the non-nearest neighbor wire sets. In this mode, the device first blurs with an equal number of switch cycles for Switch Sets A and D, and then for a possibly different number of switch cycles with one of the other switch sets. The switch cycle ratio determines the degree of anisotropy. The direction of anisotropy is the direction of the additional switching. The results of such a process is shown in FIG. 131. The point image has been blurred for 400 switch cycles for Switch Sets A and D, and 420 switch cylces with Switch Set E. Note that the non-nearest neighbors have five times the diffusive effect of nearest neighbors, because they connect cells which are a distance $\sqrt{5}$ away from each other. Hence the blur of FIG. 13I is equivalent to the blur of 13H, but along a different direction of anisotropy.

Alternative switching sequences are possible. For example, by switching several different sets at different switch cycle ratios, one might be able to achieve anisotropic blurring in any direction, particularly with the alternative topology shown in FIGS. 6–8. However, blurring along multiple non-nearest neighbors introduces aliasing effects hence it is preferred for only one set to be active for a blurring operation.

Reference Capacitors

Figure 14:
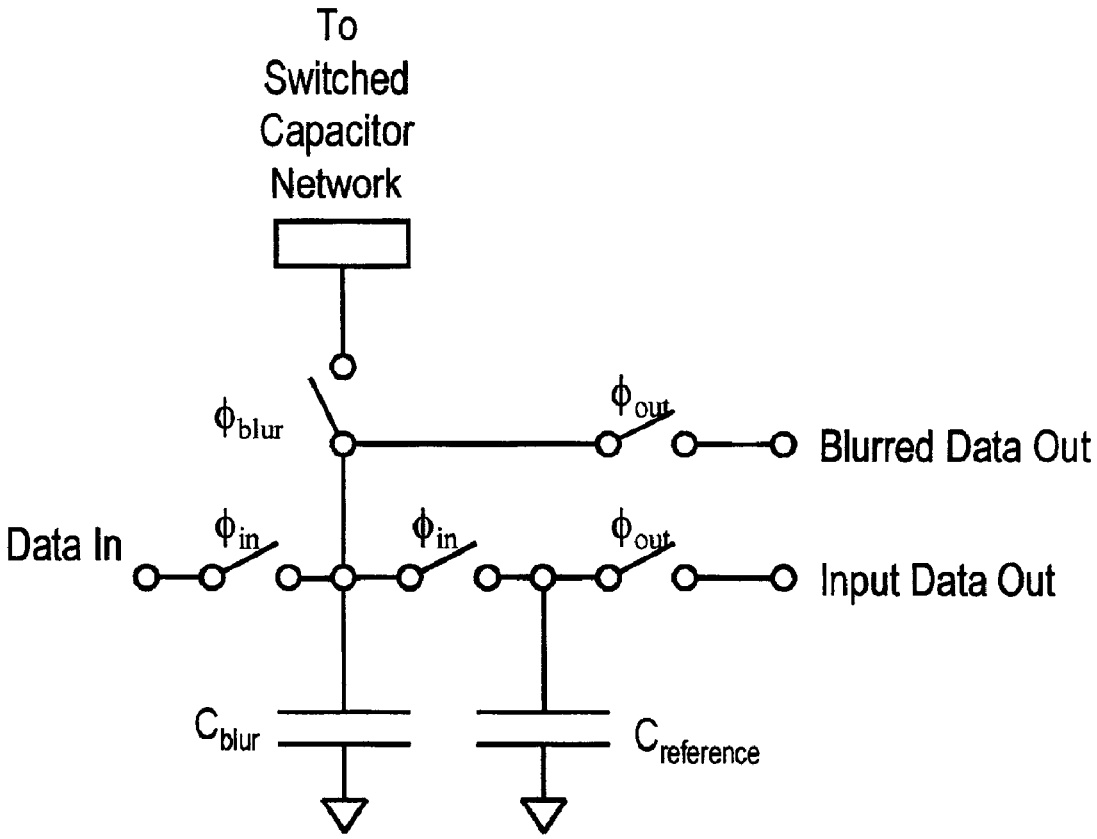
FIG. 14 is a diagram of the blur capacitor and reference capacitor.

In an alternate embodiment, each unit cell in the chip uses two capacitors to store the incoming voltage (which is proportional to the intensity of the corresponding pixel in the original image). Such an embodiment is shown is FIG. 14. One capacitor, the reference capacitor, remains isolated throughout the blurring cycle, preserving the original applied voltage. The other capacitor, the "blur" capacitor, is connected to the switched capacitor network during the blurring. After the blurring, the voltage on the blur capacitor can be subtracted from the voltage on the reference capacitor. This allows high pass filtering operations to be performed within a single chip. In the preferred SCSFC embodiment, high pass filtering is implemented through a system architecture using more than one chip.

Band Pass Filter Operation

Band pass filtering is achievable as the difference of two different low pass filters. That is, two chips blur the input data in parallel for different numbers of switch cycles and the output of one is subtracted from the output of the other, resulting in a band pass filter. Alternatively, two chips in cascade, one configured for low pass filtering and the other for high pass filtering, also result in a band pass filter. The parallel configuration is equivalent to the cascade since convolution is distributive, and the convolution of two Gaussian low pass filters is another Gaussian low pass filter. The parallel configuration of a band pass is preferred over the cascade because it does not require a high pass mode of operation and there is one fewer frame of delay.

One-Dimensional Scale Analysis

Figure 15A:
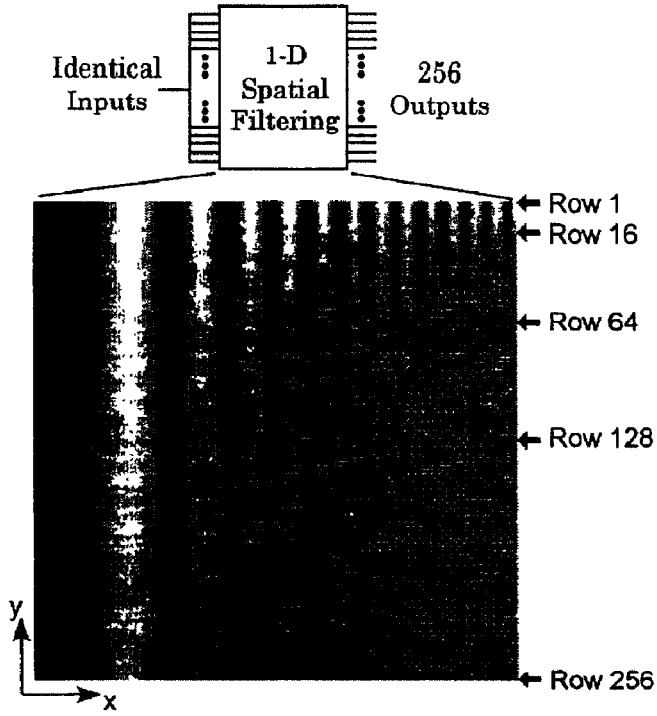
FIG. 15A is a scalogram, where each row receives the same input, but each row blurs a different amount.
Figure 15B:
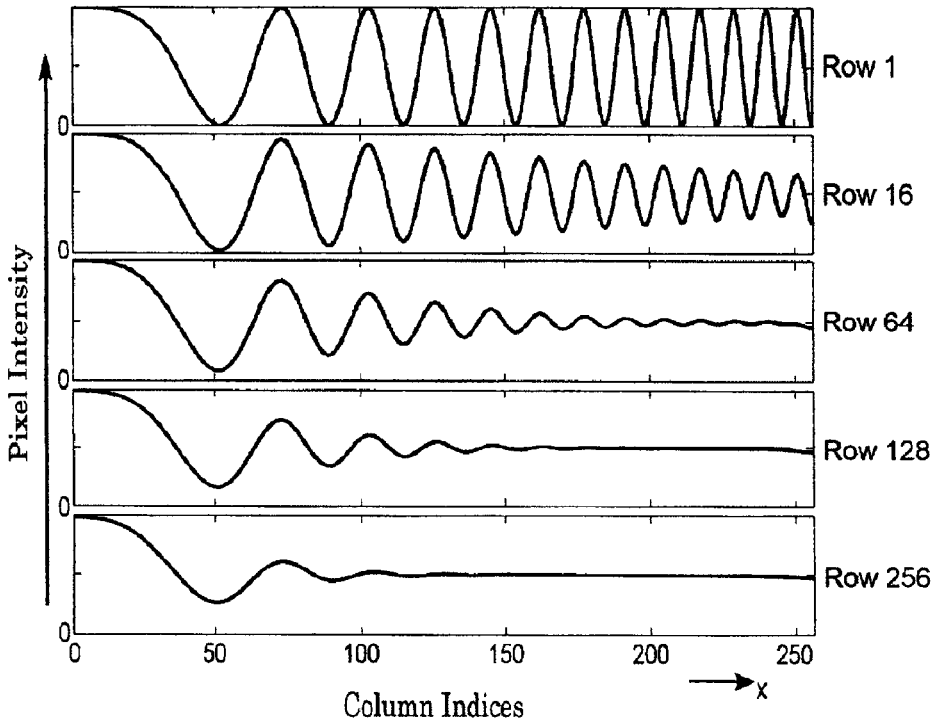
FIG. 15B shows 1-D plots of some of the rows of FIG. 15A.

In an alternative mode of operation, the chip comprised of switched capacitors can be used to perform multiple one-dimensional Gaussian convolutions simultaneously. The same set of one-dimensional data is loaded onto each row, and then each row blurs for a different number of switch cycles. This is shown in FIG. 15A, where the input data is a chirp signal and the number of cycles varies linearly from 0 switch cycles (in the top row) to 2550 switch cycles (in the bottom row). This corresponds to convolving the data with Gaussians of different scales. It can also be interpreted as a solution of the one-dimensional diffusion equation where each row is a different time slice. The arrows in FIG. 15A point to selected rows whose output data is plotted in FIG. 15B. Note that the data for Row 1 is unaltered and is the same as the original input data. In the preferred embodiment of the chip, data words can be sent to the chip controlling the number of switch cycles each row is blurred. For simplicity of control, the number of cycles varies linearly with a fixed offset. In the example of FIG. 15A, each row was blurred for 10 cycles more than the previous row. More complicated internal logic would allow for a more complicated progression. This technique can be extended using additional logic and spatial filtering chips in a parallel architecture and to perform wavelet scaleogram analysis.

Description—Programmable Spatial and/or Temporal Filtering Apparatus

Figure 16:
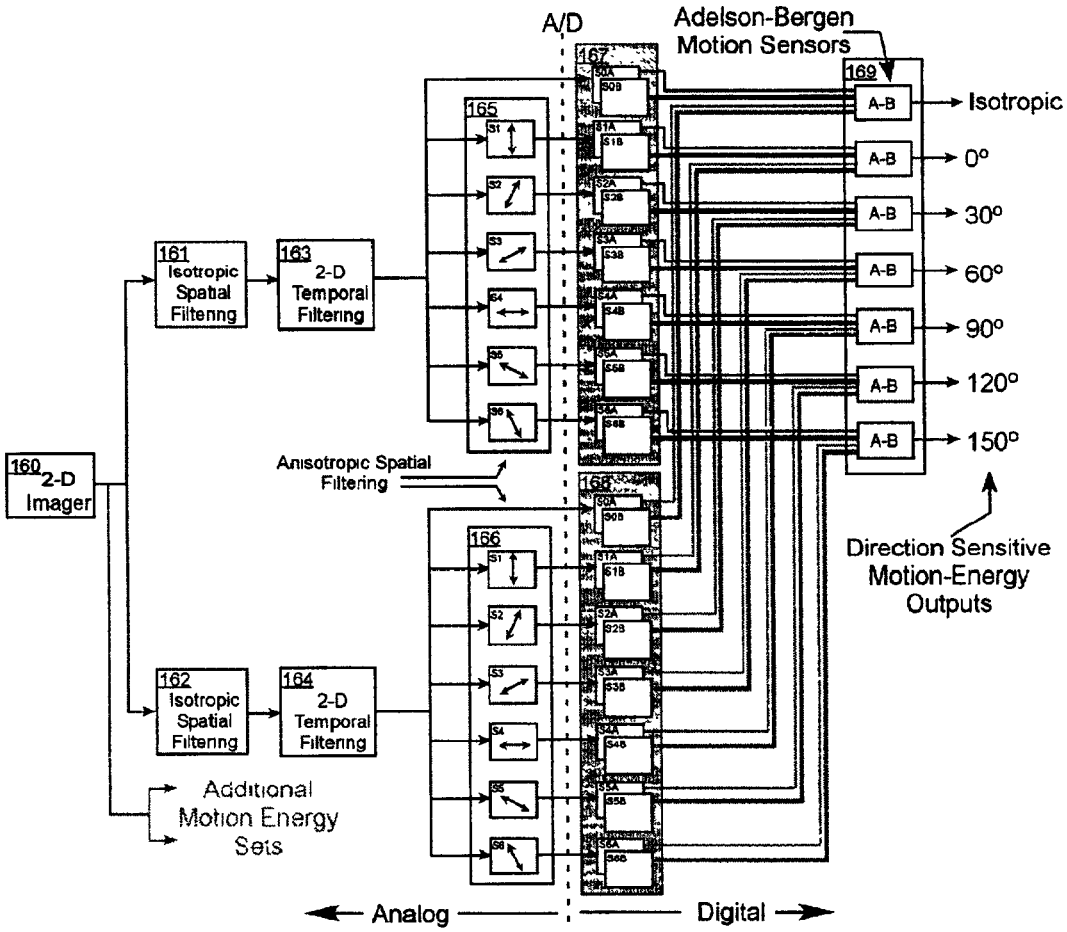
FIG. 16 is a Diagram of the dataflow within the spatio-temporal apparatus.
Figure 17:
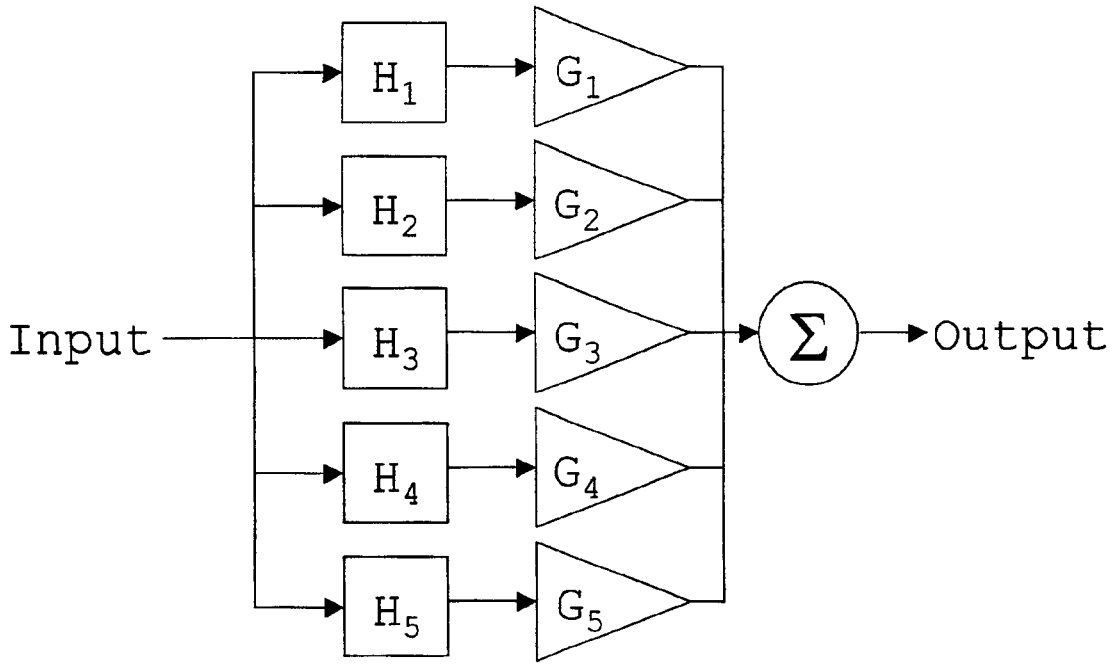
FIG. 17 is a Diagram of the parallel architecture for spatial and temporal filtering chips.

The apparatus is a programmable image processing system employing a plurality of analog VLSI spatial and/or temporal filter chips to perform spatial, temporal and spatio-temporal processing of time dependent 2-D image data in the analog domain. It consists of parallel and/or cascaded combinations of analog spatial and/or temporal filter chips depending upon the specific application. The filtering apparatus provides basic operations such as gain, offset, signal summation, signal multiplication, and frame delay in addition to the spatial and temporal chip power requirements and filter chip addressing for controlling its mode of operation. The spatial processing chip's mode of operation, low pass or high pass, and the filtering parameters for each spatial and temporal filter chip is intraframe programmable. A preferred embodiment is shown in FIG. 16 and demonstrates how the output of two spatio-temporal filters can be combined to yield motion information. The upper branch in FIG. 16 consists of the sequence of analog domain filtering stages 161, 163 and 165, followed by analog to digital conversion. The analog filtering stages of the lower branch are labeled 162, 164 and 166. First, 2-D image data 160 is input to a set of analog spatial filters 161 and 162 where full frame isotropic spatial filtering is performed. The filter settings defining the filtering operation are independently controlled. In the preferred embodiment, the spatial filtrering blocks 161, 162 are themselves a parallel combination of spatial image filter chips, each capable of having unique multiplicative weights. The parallel architecture is schematically illustrated in FIG. 17. Each individual filter chip $H_i$, be it spatial or temporal, within a parallel grouping can be multiplicatively weighted (positively and negatively) using the gain stage $G_i$ prior to being combined algebraically. The output of each parallel combination of filter chips then serves as the input signal to the next set of spatial or temporal filter chips. Some or all of the spatial filter chips in the parallel configuration can be set to filter anisotropically.

Temporal band pass filters, implemented in temporal filter chips similar to the spatial filter chips, are also used in the filtering apparatus. Each frame, the data is loaded on to an array of cells where each cell contains circuitry performing both a temporal low pass and high pass filtering operation. Returning to FIG. 16, the isotropic spatially filtered imagery is passed to temporal filtering stages 163 and 164. In the preferred embodiment, the two temporal filter stages should have, or approximate, a quadrature phase relationship with respect to one another to achieve an optimal measure of scene motion. In an alternative embodiment, the temporal filtering stage precedes the spatial filering stage: 163 precedes 161, and 164 precedes 162, in each arm of FIG. 16. Dependent upon the particular application, the temporal filtering stages can operate in either a cascaded configuration or in the parallel architecture of FIG. 17, wherein the gains can have either sign. This approach allows the equivalent of a cascade of low and high pass chips using only low pass chips.

The Spatio-Temporal (S-T) filtering apparatus also allows the option of performing anisotropic analog domain spatial filtering at six different orientations. This functionality, possibly using either anisotropic TAIP spatial filters or the SC filter chip, is shown in FIG. 16 for the preferred embodiment of the SC filter chip as filtering stages 165 and 166. In each branch of the apparatus, the analog data is A/D converted following aniosotropic filtering.

Figure 18:
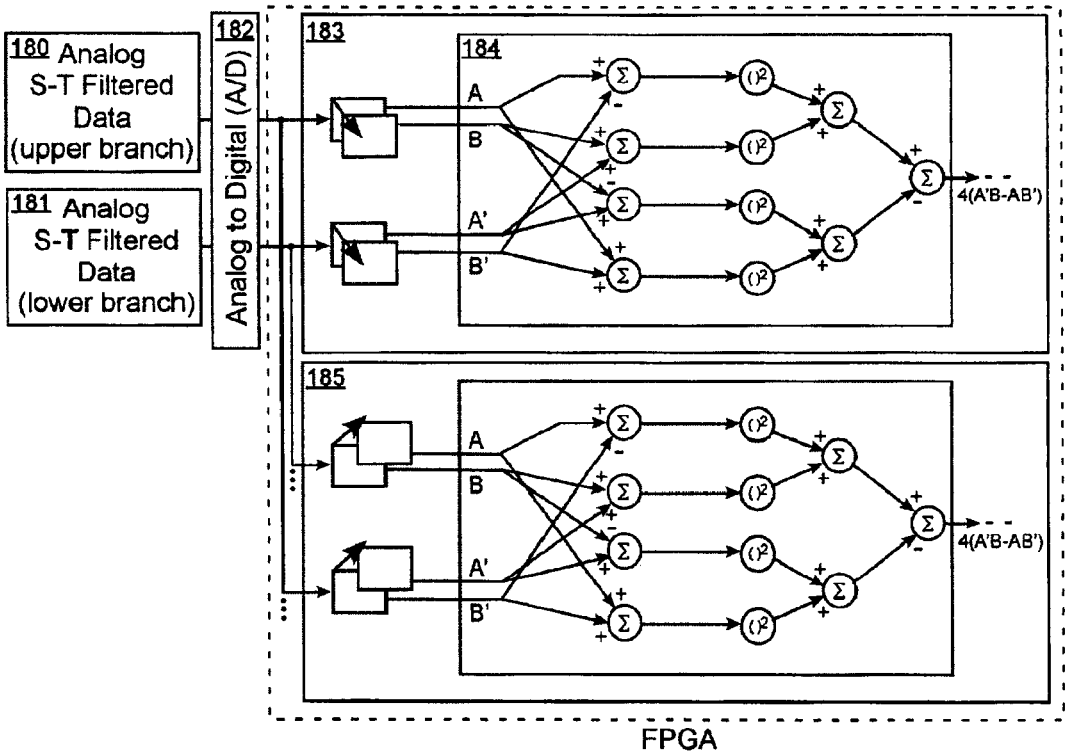
FIG. 18 is a Diagram of the motion energy computation operating on the digitized and spatially shifted spatio-temporally filtered data.

In the preferred embodiment of the S-T filtering apparatus, the spatio-temporally filtered data can be further processed in the digital domain using an FPGA to implement the Adelson-Bergen [9] scene motion computation. This requires full frame spatial shifting, shown in FIG. 16 as processing stages 167 and 168, and the algebraic combining 169 of the filtered and shifted outputs from both branches. Spatial shifting of each frame of filtered data relative to itself is necessary to achieve motion sensitivity in a specific direction and for a particular position rate of change (velocity) across the scene. The motion computation operates on the spatially isotropic S-T filtered data as well as on each of the six spatially anisotropic orientations allowed by the preferred embodiment of the SC chip. Details of the motion computation for a single spatial filtering and two spatial shifts, differing in both magnitude and direction, are shown in FIG. 18. The Analog S-T filtered data from each branch of the apparatus 180 and 181 are first digitized and then passed to an FPGA. Within the FPGA, the S-T filtered data from each branch is shifted by motion processing block 183, thereby generating four data streams required by the motion algorithm computation 184. The motion processing block 183 is shown repeated as 185 in FIG. 18 to give motion sensitivity in the two different directions shown. The two different directions also differ in magnitude and therefore are sensitive to velocities having different scalar magnitudes. In a filterbank approach, the motion processing block computation should be repeated (d*v) times to achieve motion sensitivity in each of (d) desired directions and for each desired velocity magnitude, (v). The motion energy output from each repeated motion processing block 183 can be subjected to further digital processing within the FPGA or by other digital means in subsequent stages.

Operation—Programmable Spatial and/or Temporal Filtering Apparatus

Specific features of the programmable filtering apparatus provide significant functionality. The parallel architecture with individual gain stages for each processor chip, used in performing isotropic spatial filtering, anisotropic spatial filtering and the temporal filtering allow for more complex filtering operations to be performed using linear filtering processors, such as the switched-capacitor spatial processor, while significantly reducing system throughput latency. Furthermore, full frame spatial filtering using either the switched-capacitor or TAIP spatial processors enables the real-time implementation of motion sensitive image processing algorithms.

Linear Spatio-temporal Processing

Linear analog spatio-temporal band pass filtering is achieved through the combination of spatial filtering, using the SCSFC or TAIP spatial processor, and temporal filtering using a temporal filter processor, in a suitable system architecture. Depending on the application, either a parallel or cascade architecture can be implemented using the filtering apparatus shown in FIG. 16. The parallel architecture (FIG. 17), using individually weighted linear spatial and temporal filtering chips allows for complex filtering operations to be performed in the analog domain using linear filtering.

Individually, each chip can only convolve with a shifted or oriented Gaussian. However we can take advantage of the linearity of convolution to achieve non-Gaussian kernels through an appropriate system architecture. Since convolution is linear, the weighted sum of convolutions of data with different kernels is equal to the convolution of data with the weighted sum of different kernels. This can be expressed as:

$$\sum_n g_n(f \otimes H_n) = f \otimes \sum_n g_n H_n \tag{6}$$

In this equation, $f$ represents the data, $g_n$ is the nth gain, or weighting coefficient, and $H_n$ is the nth transfer function or kernel. Hence we can take the output of several different chips, possibly apply a different gain (positive or negative) to each of them, and sum to achieve convolution with a non-Gaussian kernel. The net kernel is the weighted sum of the shifted and/or oriented Gaussian kernels of the individual spatial filtering chips. This can be done with several chips in parallel, as shown in FIG. 17. Each rectangular block is a switched capacitor spatial chip or equivalent chip, and the triangular blocks are gain stages. For example, band pass and high pass filters are convolutions with non-Gaussian kernels.

Shifting

The programmable S-T filtering apparatus and design of the switched-capacitor spatial processor allow for shifts in the output of one or more spatial chips. This means spatially shifting one or more pixels in the x and/or y direction(s). This can be implemented in at least two different ways: in analog by altering the timing of the signal as it is loaded in, or after digitization. Without shifting, the convolution kernels can only be symmetric, because all Gaussians, whether isotropic or anisotropic, are symmetric, and the weighted sum of symmetric functions is symmetric. However, by appropriately shifting and weighting the outputs of sufficient chips, and by adjusting the blurring parameters, one can achieve a convolution with any function. This is implemented both in the analog domain in the filtering apparatus to enable gradient operations by adjusting the timing of the data stream as it is loaded onto the spatial and temporal processors, as well as in the digital domain in the motion-energy computation.

Computation of Image Gradients

The image filtering apparatus allows asymmetric convolution operations to be performed using the linear spatial filtering processors through the combination of spatial shifting and subtraction. The simplest way to compute the components of a gradient of an image is just to use a first-order difference operator, based on the approximation:

$$\Delta x \cdot \frac{\partial f}{\partial x} \approx f(x+\Delta x) - f(x) \tag{7}$$

In other words, we subtract the image from itself, shifted by one or more pixels in the direction of interest. However, this approach is overly sensitive to noise. To alleviate this one can blur the image by convolving with a Gaussian. Accordingly, one can use two spatial blurring chips with the same blurring parameters, where one is shifted and the other is not (or shifted differently), and then subtract them from each other. The effective convolution kernel is then the derivative of a Gaussian. Convolving data with the derivative of a Gaussian is equivalent to the derivative of the data convolved with a Gaussian.

Moreover, mixed partial derivatives are possible with multiple chips added or subtracted in parallel, each shifted differently. Even degree derivatives are symmetric and are possible without shifting. They are easily achievable by taking advantage of the fact that the difference of two Gaussians approximates the second derivative of a Gaussian. For example, the second-degree derivative in the x direction can be computed with the apparatus in the parallel architecture as the difference of two anisotropic filters. The two filters blur for the same number of cycles in the y-direction, but for different numbers of cycles in the x-direction. Also note that the difference of two isotropic filters (also known as a band-pass) computes the Laplacian of the data.

Basis Function Control

Although the blurring kernels for the processor chips are fundamentally Gaussian, algebraically combining the output of many individually gained chips allows the S-T filtering apparatus to implement non-Gaussian kernels. Furthermore, by spatially shifting the relative output timing between the processor chips prior to summing the multiple output streams, image gradients and mixed partial derivative operations can be implemented. In FIG. 17, a parallel combination of either spatial or temporal chips $H_i$ are shown where each can be weighted with unique gains $G_i$ prior to being summed. This high degree of functionality provides for a substantial degree of basis function control. Essentially, a very large class of image processing operations can be performed on 1-D and 2-D imagery using the S-T filtering apparatus, including continuous wavelet transforms. [6] A full continuous wavelet transform involves convolving data with a wavelet at all different scales and orientations. The apparatus can be used to convolve data with a wavelet at a selected number of scales orientations simultaneously.

Motion Energy

A non-linear spatio-temporal motion energy computation can be implemented using the spatio-temporal filtering apparatus. An imaging camera samples the scene it views at a certain frame rate. The image in each frame can be represented as a pattern in a two dimensional (X,Y) coordinate system. X and Y represent the locations of distinct features on the camera focal plane. Objects that have relative motion with the respect to the camera will change their (X,Y) location from frame to frame and can therefore be represented as a series of patterns in a three dimensional coordinate system; X, Y and time. Using spatial and temporal filtering devices, it is possible to construct spatiotemporal filters that are sensitive to narrow bands of spatial and temporal frequency, i.e., sensitive to image features which are a certain size and moving at a certain velocity. The motion energy approach is a generalization of the problem of computing spatial orientation to the case of 3-D (2-D space-1-D time) matching. This approach has the advantage of not requiring object spatial tokens for identification. Rather the method determines motion energy as a local property of spatio-temporal stimuli. [7]

Figure 1C:
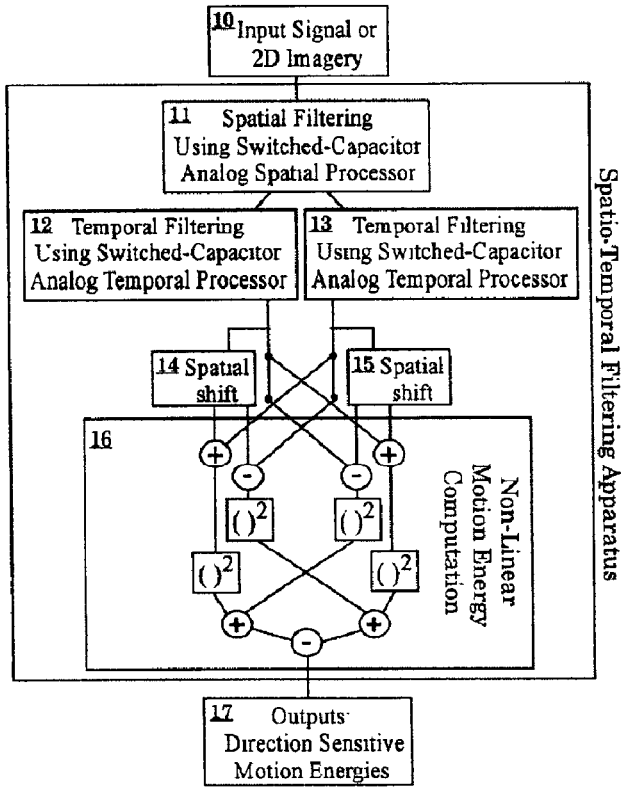
FIG. 1C illustrates a nonlinear spatio-temporal motion energy apparatus in accordance with the present invention.

The motion-energy computation operates on the spatio-temporal filtered imagery to compute relative motion between the imaging detector and all objects within the imaged scene. This is schematically illustrated in FIG. 1C. Input imagery 10 is spatially 11 and temporally filtered 12 and 13 in the analog domain using the spatial and temporal filtering chips prior to the non-linear motion energy computation. Spatially shifting the S-T filtered imagery 14 and 15 and combining the result 16 produces the direction sensitive measure of scene motion 17. The parallel architetcture implementation of both the spatial 11 and temporal filtering stages 12 and 13 of FIG. 1C enables the flexible implementation of a large class of S-T convolution operations by allowing the impulse function to be tailored to any symmetrical or asymmetrical shape. This very important feature allows for more complex filtering transfer functions than can be accomplished using the Gaussian band pass filtering of the individual spatial and temporal filtering chips. For a stable imaging detector, the computed motion energy yields a direction sensitive measure of the absolute velocities of all objects within a scene having the motion direction and rate of change in position selected by the filter apparatus spatial band pass and temporal band pass settings.

Applications and Methods

One can use the above-described analog VLSI chip and image processing apparatus in a variety of different applications and some of these methods are described below. In what follows, the analog spatial blurring chip is referred to, in block form, as a single element in a larger system, the spatial and/or temporal filtering apparatus. The systems are combinations of analog and digital electronics. Important operational embodiments and the description of the programmable image/signal processing apparatus appear above. The spatial blurring chip is a key element of the systems without which the systems would not be possible with previously available technology.

The spatial blurring chip can be considered a block in a system diagram having five different parameters: extent of isotropic blurring, relative degree of anisotropy, direction of anisotropy, shifting in the x-direction, and shifting in the y-direction. The present inventors also make use of basic operations such as gain, offset, signal summation, signal multiplication, and frame delay. This makes it possible to implement a frame delay by using a spatial blurring chip without doing any blurring; the data is on-loaded, delayed by a frame, and off-loaded.

Optical Flow

One gradient-based method of computing optical flow [8] [9] involves computing the solution of the equation:

$$\begin{bmatrix} \sum f_x^2 & \sum f_x f_y \\ \sum f_x f_y & \sum f_y^2 \end{bmatrix} \cdot v = \begin{bmatrix} -\sum f_x f_t \\ -\sum f_y f_t \end{bmatrix} \tag{8}$$

This is a 2D matrix equation that must be solved for every pixel to determine the optical flow vector v at each pixel. The x and y spatial gradients of the input image data are denoted $f_x$ and $f_y$ respectively. The time derivative of the image data is denoted as $f_t$. The gradient products are summed with weights over a local area. The spatial gradients can be computed in analog with spatial blurring chips, such as the Switched Capacitor Spatial Filter Chip, using the shifting capability of the filtering apparatus by adjusting the timing of the image data loading. Similarly, the temporal derivative can be computed with temporal filter chips. The products of the gradients can be computed in the analog domain as well. The weighted summation over a local area is just a convolution with a Gaussian, so it can be done efficiently in analog with spatial blurring chips. Solving the matrix equation for the optical flow vector s is then achieved through straightforward multiplying, subtracting, and dividing.

Nonlinear Spatio-temporal Motion Energy

As described in the paper by Adelson and Bergen [7], the motion of an object in an image can be detected by computing the energy present in a bank of spatio-temporal frequency filters. One can build a linear filter that is responsive to energy in a small, localized band of spatial and temporal frequency; that is, it responds best to a certain spatial frequency moving at a certain velocity. Any such linear filter must be non-separable in space and time, and will have an output with an undesirable dependency on the phase of the stimulus. Adelson and Bergen showed how it is possible to combine the outputs of multiple linear filters nonlinearly (by summing the squared outputs of a quadrature pair) to create a phase-independent motion energy filter. To estimate the motion over all spatial frequencies at any given velocity, it is necessary to create multiple motion energy filters at a range of spatial and temporal frequencies. In 1D, all the filters that correspond to the same velocity form a line passing through the origin in the spatiotemporal frequency plane. By populating the entire spatiotemporal frequency space with a bank of filters, it is possible to estimate the motion of an arbitrarily complex stimulus (covering a range of spatial frequencies) at any velocity. A very efficient multiresolution arrangement of filters is a wavelet-like distribution [10], in which the frequency bandwidth of successive filters (in two dimensions of space and one of time) is constant on a frequency log scale. Thus low frequencies are covered at high resolution, higher frequencies are covered at reduced resolution, and the total number of filters is reduced over a linear coverage. Because in this scheme there are separate simultaneous filters looking for motion energy at different velocities and spatial frequencies, the possibility of multiple representations of motion at the same location is allowed.

Scene Based Adaptive Nonuniformity Correction:

In one alternate embodiment, the spatial filtering apparatus can be configured to efficiently implement an adaptive nonlinear iterative algorithm [11] for removing fixed pattern noise from a video stream can be implemented using the methods and apparatus of this disclosure. In summary, nonuniformity correction (NUC) of infrared imagery due to pixel variations over the focal plane generate fixed pattern noise (FPN), requiring the correcting of the per pixel gain G and offset O values. In this NUC implementation, the gain and offset coefficients for the input imagery X are simultaneously corrected to produce the corrected output imagery Y in an adaptive feedback scheme, $$\begin{aligned} &Input: X(t) \\ &\text{Offset}: O(t) = O(t-1) - 2\alpha[Y(t) - Y(t) \otimes Sinc] \\ &\text{Gain}: G(t) = G(t-1) - 2\alpha[Y(t) - Y(t) \otimes Sinc] \\ &\text{Output}: Y(t) = X(t)G(t-1) + O(t-1) \end{aligned} \tag{9}$$

which continuously compensates for detector drift and changes in background illumination. The parameter $\alpha$ controls the convergence rate and must be chosen sufficiently small to ensure stability. In digital implementations, Sinc function convolution is performed serially over the scene and therefore requires multiple processors to handle moderate dimension kernels. Our analog implementation utilizes a parallel combination of the analog spatial filtering chip to perform a spatial band pass convolution to approximate a Sinc function, and as memory storage to realize a frame delay for both offset O(t−1) and gain G(t−1) correction. Performing the spatial band pass convolution in the analog domain using a switched capacitor chip is enabling for both high frame rate operation and large frame sizes. In particular, NUC must be implemented in the analog domain in applications where the output of an analog FPA detector is to be filtered in the analog domain.

Dynamic Programming

The dynamic programming (DP) detection algorithm is described in detail in reference [12]. DP is a recursive search procedure that carries out the equivalent of an exhaustive search of feasible target hypotheses to detect and track targets which are at best only frame intermittently detectable using single frame thresholding. To implement this search, the possible target tracks are quantized into a collection of candidate target states in a 4-D space that covers two position dimensions, speed, and orientation of motion. The state space required for target detection is ideally suited to the computational capabilities of analog spatial and temporal image processors and, in particular to non-linear spatio-temporal motion-energy analysis. At each time step, a set of scores is generated which represent the cumulative likelihood of target occupancy for every candidate target state. The detection procedure then locates local maxima in the scores and thresholds them based on the level of confidence implied by their magnitude. This further qualifies the S-T filtered imagery by excluding objects which do not satisfy the assumed target model. DP, implemented using analog spatial and temporal filtering as the input, provides a robust, high performance and computationally tractable detection system able to track multiple targets having different relative motion in cluttered backgrounds.

Rotational Dynamics:

Spatio-temporal filtering can be used to identify the rotational dynamics of distant objects provided there is at least some unique spatial information over more than one focal plane pixel [13]. The spatial information does not necessarily have to be above the noise level of a single frame. Because this technique relies on a fusion of both temporal filtering and a spatial correlation analysis, the estimation of temporal dynamics is less sensitive to noise than temporal only approaches.

In computing the motion energy for all detected objects within a scene, full frame spatial and temporal filtering must be performed to serve as the input for the motion energy computation. This is a computationally demanding task that can be efficiently implemented using analog spatial image processors, such as the SC filter chip or the TAIP, and analog temporal filtering. Depending on the complexity of the detected scene, the motion energy can be either determined over the entire scene or for specific regions of interest qualified by the spatio-temporal filtering. Using the computed motion-energy M(x,y) in a temporal filter bank approach for arbitrary motion in the focal plane, i.e. along the directions, [(x,y): (1,0), (1,−1), (0,−1), (−1,−1), (−1,0), (−1,1), (0,1), (1,1)], the power spectra for spatial correlations of all pair-wise combinations of the direction specific motion-energies can be analyzed to extract temporal dynamics and orientation within the focal plane. In other words, for objects having an asymmetric body axis, the frequency positions and relative strengths of the peaks formed by the pair-wise products of the time domain Fourier transforms (FFT) for each motion-energy direction $M_{(x,y)}$, $$\prod_{\substack{x,y,x',y' \\ x\neq x',y\neq y'}} [FFT(M_{(x,y)}) * FFT^{*}(M_{(x',y')})]$$

reflect both the object's temporal dynamics and provides a measure of the object orientation on the focal plane. The utility of this approach in estimating the precession rate of variously oriented conical targets as a function of the distance between the target and the detector has been recently outlined [14].

Closely Spaced Objects:

Two objects are considered "closely spaced" when a detector's spatial sampling lacks the resolution to clearly resolve the detected irradiances as two separate objects. Provided the detector system and range to target allow for more than one pixel of spatial sampling, the rotational dynamics analysis described above can be applied to cases where two objects fall within the CSO regime to yield the individual temporal characteristics of each object. The combined irradiances of the two CSO objects will have a spatial distribution reflecting the spatial orientation of the two objects. Consequently, tiling the rotational dynamics analysis over the computed scene motion energy determines the spatial distribution of the temporal characteristics for the aggregate target intensity variations [14].

Figure 19A:
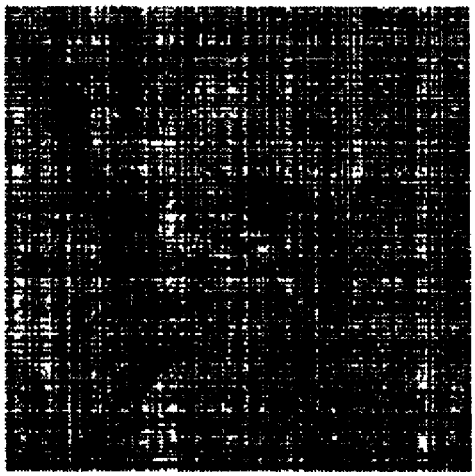
FIG. 19 demonstrates the removal of fixed pattern noise using anisotropic filters.
Figure 19B:
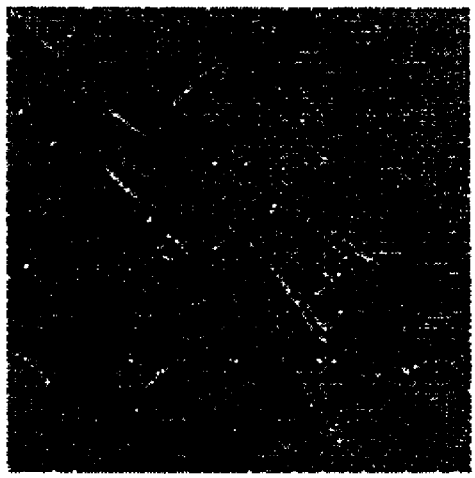

Removal of Fixed Pattern Noise:

A spatial frequency filter that is constructed by taking the difference of two differently oriented Gaussian blur kernels can be used for removing fixed pattern "plaid" noise from an image. FIG. 19 demonstrates a potential application of a tunable wavelet filtering operation based on differencing anisotropic Gaussians to the removal of oriented noise features from an image. FIG. 19A shows an image with horizontal and vertical noise stripes. FIG. 19B shows the result after the difference of anisotropic Gaussians filter has been applied. This detects edges in all directions other than in the purely horizontal and purely vertical directions. Edge features, either horizontal or vertical, are completely removed. We are not limited to only horizontal and vertical directions, but all the different possible combinations of six different directions of anisotropy, roughly every thirty degrees.

Figure 20:
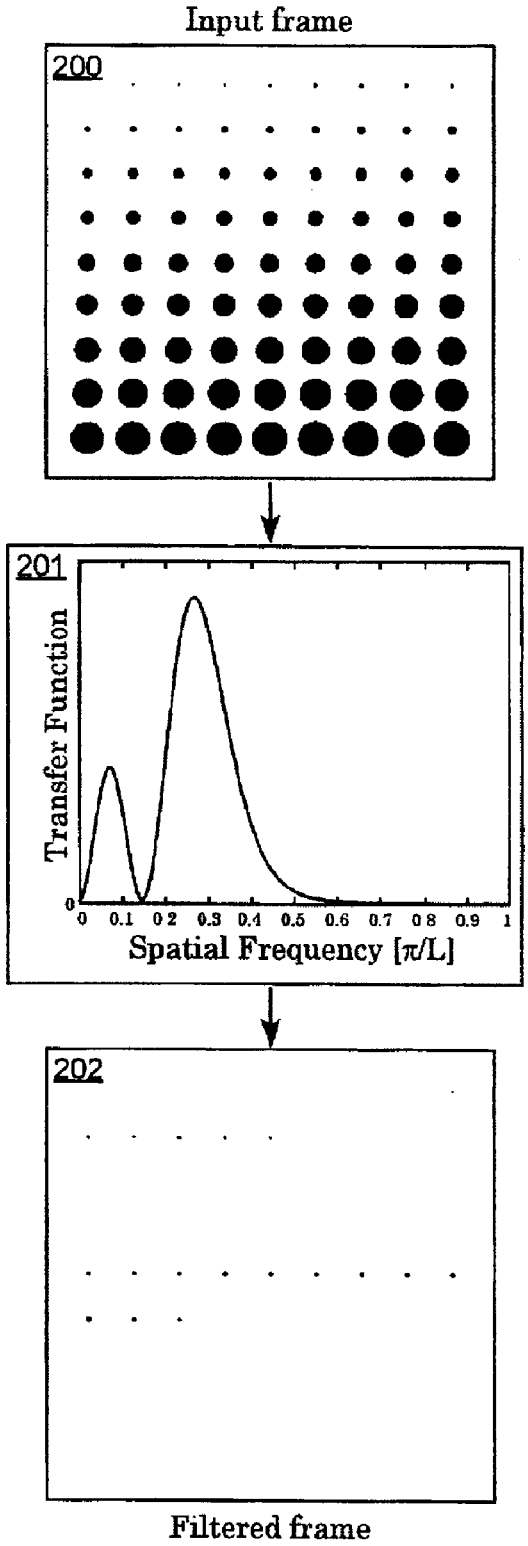
FIG. 20 demonstrates the bimodal filter example.

Multimoded Spatial Filtering:

The S-T filtering apparatus can filter for two or more different spatial length scales simultaneously, FIG. 20. The input image 200 shows an array of circles of different sizes. It is filtered with the apparatus set to have a particular spatial transfer function 201. After a threshold is applied, the result 202 shows that two distinct ranges of spatial length scales are selected. The architecture that achieves this consists of four spatial switched cap chips in a parallel configuration of FIG. 17. For the bimodal transfer function of FIG. 20, the chips are set to blur isotropically for 185, 250, 335, and 530 cycles with /respective gain settings of 2.17, −5.74, 4.57, −1. Similar bimodal or trimodal functions are also possible with other chip and gain settings. The applied threshold makes the selectivity of the filter more pronounced.

EXAMPLES

Cruise Missile Detection:

For a cruise missile or aircraft moving with respect to an earth background and viewed by an imaging seeker on an interceptor, both the background and the cruise missile target will exhibit relative motion with respect to the interceptor. However, the earth background will have motion determined by the interceptor's trajectory and the target will have a relative motion (different than the background) determined by the relative velocity between the interceptor and the target. In addition, most of the resolved feature sizes of the background will not have the same spatial extent and/or 2D aspect ratio as the target. Thus, 2D spatial frequency filtering of a scene to extract only those features which are comparable in size and shape to the target, followed (or preceded) by temporal filtering of a series of scenes and extracting the features which have a prescribed relative motion through the motion-energy computation acting on the filtered data, provides an enhanced target detection process. The utility of full focal-plane spatio-temporal filtering and motion energy analysis using the analog VSLI spatial and temporal image processors has been demonstrated through enhanced cruise missile detection against a highly cluttered moving background [13].

Plume and Hard Body:

This example demonstrates how S-T filtering can be used to reduce the dynamic range of the data while retaining the important scene information. For aim-point selection synthesis in military intercept engagements, certain target characteristics must be identified to establish a target body reference. A predetermined spatial offset from this reference serves as the aim-point. In national missile defense boost-phase intercept engagements, intercepting missile infrared detectors have difficulty in responding to the signal dynamic range of the boosting rocket and in fact become saturated by the hot exhaust plume. Spatio-Temporal filtering in the analog domain provides a means through local contrast control by which the scene imagery dynamic range can be dramatically reduced by many orders while retaining sufficient spatial information to differentiate between the plume and hardbody [13]. This demonstrates how local contrast adaptation based on high pass spatial frequency filtering technology can detect object edges from other image phenomena, such as the hot exhaust plume, thereby exploiting the full dynamic range of the instantaneous infrared detector response.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What we claim is:

1. A programmable apparatus operable for spatial frequency filtering of two dimensional (2-D) signal data comprising a planar array of grounded capacitors charged in proportion to signal data values, wherein each grounded capacitor of said planar array of grounded capacitors is interconnected to other grounded capacitors by at least one switched capacitor to provide electrical connection therebetween and allow charge sharing between said planar array of said grounded capacitors through said intervening switched capacitors for the purpose of performing 2-D spatial domain filtering; and wherein each of said grounded capacitors comprising said planar array has an (x,y) coordinate and neighboring grounded capacitors disposed at (x,y) offset coordinates of (0,+1), (+1,0), (0,−1) and (−1,0) with respect to said (x,y) coordinates of each said grounded capacitor for effecting isotropic or oriented anisotropic spatial filtering; and a clock providing clock pulses operable for switching said switched capacitors for adjusting the spatial extent of the spatial frequency filtering.

2. The apparatus of claim 1 wherein each grounded capacitor is further electrically connected by a switched capacitor to neighboring grounded capacitors at (x,y) coordinate offsets including but not limited to (+1, +2), (+2, +1), (+2, −1), (+1, −2), (−1, −2), (−2, +1), (−2, +1), and (−1, +2) with respect to (x,y) coordinates of said each grounded capacitor.

3. The apparatus of claim 1 wherein each grounded capacitor is further electrically connected by a switched capacitor to neighboring grounded capacitors at (x,y) coordinate offsets including but not limited to (+1, +1), (+1, −1), (−1, −1), and (−1, +1) with respect to (x,y) coordinates of said each grounded capacitor.

4. The apparatus of claim 1 further comprising a reference capacitor operable for differencing filtered signal data from said signal data.

5. The apparatus of claim 4 wherein said one and two dimensional signal data comprises a data array having at least one row of signal data and wherein said clock provides independent switched capacitor control of a row of signal data for implementing independent one-dimensional spatial filters for performing computations including, but not limited to wavelet scalogram computations.

6. The apparatus of claim 1 further comprising means for changing operability of said apparatus from a low pass spatial frequency filter to a high pass spatial frequency filter.

* * * * *